US008706480B2

(12) United States Patent
Herre et al.

(10) Patent No.: US 8,706,480 B2
(45) Date of Patent: Apr. 22, 2014

(54) AUDIO ENCODER FOR ENCODING AN AUDIO SIGNAL HAVING AN IMPULSE-LIKE PORTION AND STATIONARY PORTION, ENCODING METHODS, DECODER, DECODING METHOD, AND ENCODING AUDIO SIGNAL

(75) Inventors: Juergen Herre, Buckenhof (DE); Ralf Geiger, Erlangen (DE); Stefan Bayer, Nuremberg (DE); Guillaume Fuchs, Erlangen (DE); Ulrich Kraemer, Ilmenau (DE); Nikolaus Rettelbach, Nuremberg (DE); Bernhard Grill, Lauf (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 977 days.

(21) Appl. No.: 12/663,828

(22) PCT Filed: Jun. 5, 2008

(86) PCT No.: PCT/EP2008/004496

§ 371 (c)(1),
(2), (4) Date: Jun. 9, 2010

(87) PCT Pub. No.: WO2008/151755

PCT Pub. Date: Dec. 18, 2008

(65) Prior Publication Data

US 2010/0262420 A1 Oct. 14, 2010

Related U.S. Application Data

(60) Provisional application No. 60/943,253, filed on Jun. 11, 2007, provisional application No. 60/943,505, filed on Jun. 12, 2007.

(51) Int. Cl.
*G10L 19/14* (2006.01)

(52) U.S. Cl.
USPC ..... 704/221

(58) Field of Classification Search
USPC ..... 704/219–230
See application file for complete search history.

(56) References Cited

U.S. PATENT DOCUMENTS 5,235,670 A * 8/1993 Lin et al. ..... 704/200
6,134,518 A * 10/2000 Cohen et al. ..... 704/201

(Continued)

FOREIGN PATENT DOCUMENTS

EP 0405548 2/1991
EP 1083547 3/2001

(Continued)

OTHER PUBLICATIONS

"Webster's New Universal Unabridged Dictionary", Deluxe Second Edition Upon the Broad Foundations Laid Down by Noah Webster, Illustrated throughout, Dorset & Baber, 1983, 650.

(Continued)

*Primary Examiner* — Abul Azad
(74) *Attorney, Agent, or Firm* — Michael A. Glenn; Perkins Coie LLP

(57) ABSTRACT

An audio encoder for encoding an audio signal includes an impulse extractor for extracting an impulse-like portion from the audio signal. This impulse-like portion is encoded and forwarded to an output interface. Furthermore, the audio encoder includes a signal encoder which encodes a residual signal derived from the original audio signal so that the impulse-like portion is reduced or eliminated in the residual audio signal. The output interface forwards both, the encoded signals, i.e., the encoded impulse signal and the encoded residual signal for transmission or storage. On the decoder-side, both signal portions are separately decoded and then combined to obtain a decoded audio signal.

33 Claims, 24 Drawing Sheets

(Encoder)

(56) References Cited

U.S. PATENT DOCUMENTS

| | | | | |
|---|---|---|---|---|
| 6,470,312 | B1 | 10/2002 | Suzuki et al. | |
| 6,789,059 | B2 | 9/2004 | Kandhadai et al. | |
| 6,928,406 | B1 | 8/2005 | Ehara et al. | |
| 6,968,309 | B1 * | 11/2005 | Makinen et al. | 704/219 |
| 7,203,638 | B2 | 4/2007 | Jelinek et al. | |
| 7,739,120 | B2 * | 6/2010 | Makinen | 704/501 |
| 7,978,771 | B2 * | 7/2011 | Sato et al. | 704/230 |
| 8,321,210 | B2 * | 11/2012 | Grill et al. | 704/205 |
| 2004/0002854 | A1 | 1/2004 | Ha | |
| 2004/0024593 | A1 | 2/2004 | Tsuji et al. | |
| 2004/0064311 | A1 * | 4/2004 | Sinha et al. | 704/219 |

FOREIGN PATENT DOCUMENTS

| | | | | |
|---|---|---|---|---|
| GB | 2403634 | | 1/2005 | |
| JP | 03033900 | | 2/1991 | |
| JP | 10-051315 | | 2/1998 | |
| JP | 10-502191 | | 2/1998 | |
| JP | 2000322097 | | 11/2000 | |
| JP | 2002372996 | | 12/2002 | |
| JP | 2003533916 | | 11/2003 | |
| JP | 3905706 | B2 | 4/2007 | |
| RU | 2289858 | C2 | 12/2006 | |
| RU | 2331933 | C2 | 8/2008 | |
| TW | 561454 | | 11/2003 | |
| TW | I233591 | | 6/2005 | |
| WO | WO-0186637 | | 11/2001 | |
| WO | 2004082288 | | 9/2004 | |
| WO | 2006030340 | A2 | 3/2006 | |
| WO | WO 2006/120931 | * | 11/2006 | G10L 19/14 |

OTHER PUBLICATIONS

Edler, et al., "Concepts for Hybrid Audio Coding Schemes Based on Parametric Techniques", AES Preprint, Presented at the 105th Convention, San Francisco, California, USA, Sep. 1998, 10 pages.

Kipper, et al., "Improved CELP Coding Using Adaptive Excitation Codebooks", IEEE Int'l Conference on Acoustics, Speech & Signal Processing, New York, USA, Apr. 14, 1991, pp. 237-240.

Ramprashad, Sean A. , "A Two Stage Hybrid Embedded Speech/Audio Coding Structure", IEEE Int'l Conference on Acoustics, Speech and Signal Processing, vol. 1, New York, USA, May 1998, pp. 337-340.

"ARDOR (Adaptive Rate-Distortion Optimised Sound Coder)", http://www.hitech-projects.com/euprojects/ardor/summary.htm.

Zwicker, et al., "Psychoacoustics, Facts and Models Second Updated Edition with 289 Figures", Springer Series in Information Sciences, 1999, pp. 151-173.

Atti, V et al., "A Simulation Tool for Introducing Algebraic CELP (ACELP) Coding Concepts in a DSP Course", IEEE., 2002, 306-311.

Bessette, B et al., "Universal Speech/Audio Coding Using Hybrid ACELP/TCX Techniques", IEEE. ICASSP., 2005, 301-304.

Edler, B et al., "Audio Coding using a Psychoacoustic Pre- and Post-Filter", IEEE. vol. 2, 2000, 881-884.

Grill, B , "A Bit Rate Scalable Perceptual Coder for MPEG-4 Audio", 103rd AES Convention. New York., Sep. 26, 1997, 21 Pages.

Harma, A et al., "Frequency-Warped Signal Processing for Audio Applications", Journal of the AES. vol. 48, No. 11., Nov. 2000, 1011-1031.

Harma, A et al., "Warped Low-Delay CELP for Wideband Audio Coding", AES 17th International Conference. Florence, Italy., 1999, 207-215.

Herre, J et al., "General Audio Coding", The MPEG-4 Book. Chapter 11. Prentice Hall IMSC Multimedia Series. ISBN: 0-13-061621-4., 2002, 487-544.

Karjalainen, M et al., "Realizable Warped IIR Filters and Their Properties", IEEE. ICASSP. vol. 3., 1997, 2205 -2208.

Kleijn, W.B. , "A Speech Coder Based on Decomposition of Characteristic Waveforms", IEEE. ICASSP., 1995, 508-511.

Kleijn, W.B. , "Speech Coding Below 4 KB/S Using Waveform Interpolation", IEEE. Globecom '91., 1991, 1879-1883.

Koishida, K et al., "CELP Coding Based on MEL-Cepstral Analysis", Proc. IEEE ICASSP'95., 1995, 33-36.

Schuijers, E et al., "Advances in Parametric Coding for High-Quality Audio", 114th AES Convention. Amsterdam, The Netherlands., 2003, 11 Pages.

Schuller, G et al., "Perceptual Audio Coding Using Adaptive Pre- and Post-Filters and Lossless Compression", IEEE Transactions of Speech and Audio Processing. vol. 10, No. 6., Sep. 2002, 379-390.

Smith, J et al., "Bark and ERB Bilinear Transforms", IEEE. Transactions on Speech and Audio Processing. Vo,. 7, No. 6., Nov. 1999, 697-708.

Spanias, A , "Speech Coding: A Tutorial Review", Proc. of the IEEE. vol. 82, No. 10., Oct. 1994, 1539-1582.

Tokuda, K et al., "Speech Coding Based on Adaptive Mel-Cepstral Analysis", Proc. IEEE ICASSP'94., Apr. 1994, 197-200.

Wabnik, S et al., "Frequency Warping in Low Delay Audio Coding", IEEE. ICASSP 2005., 2005, 181-184.

* cited by examiner

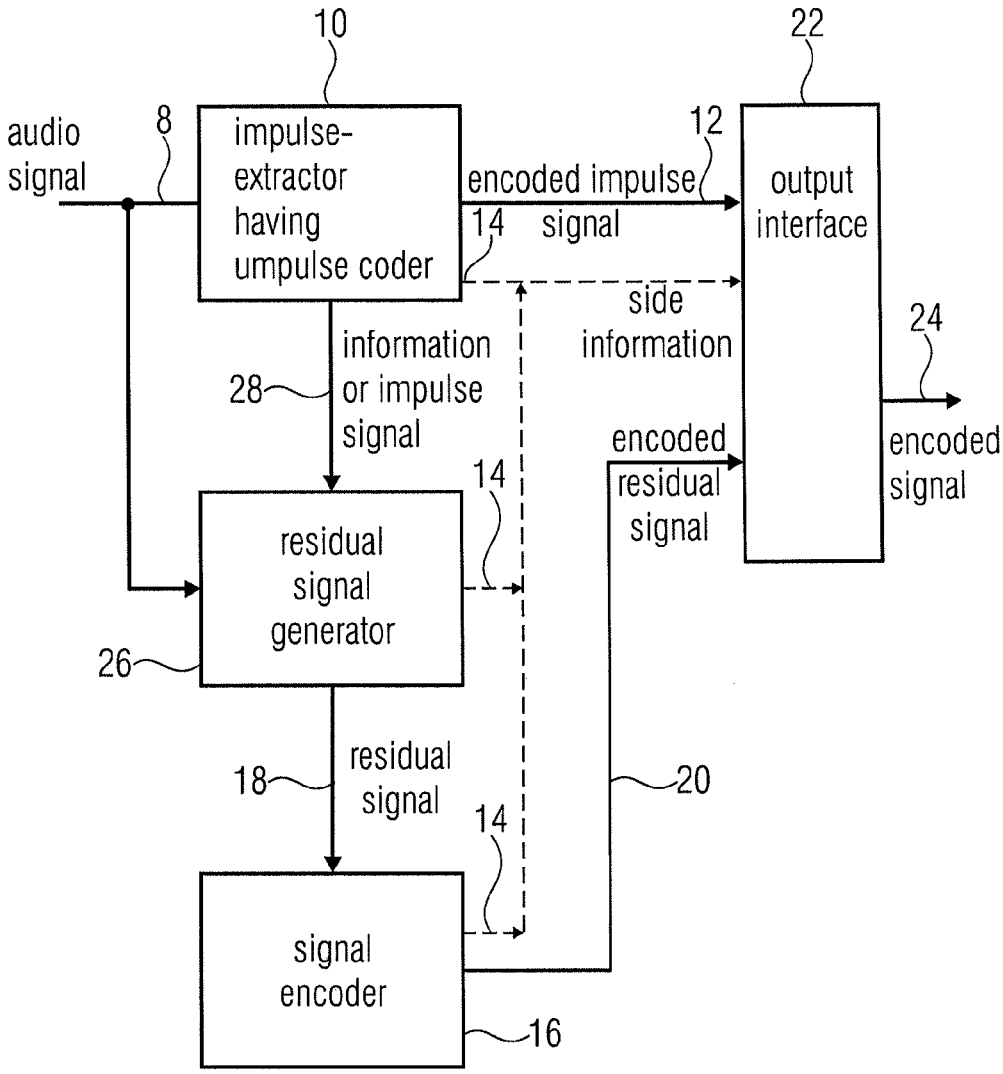
FIG 1 (Encoder)

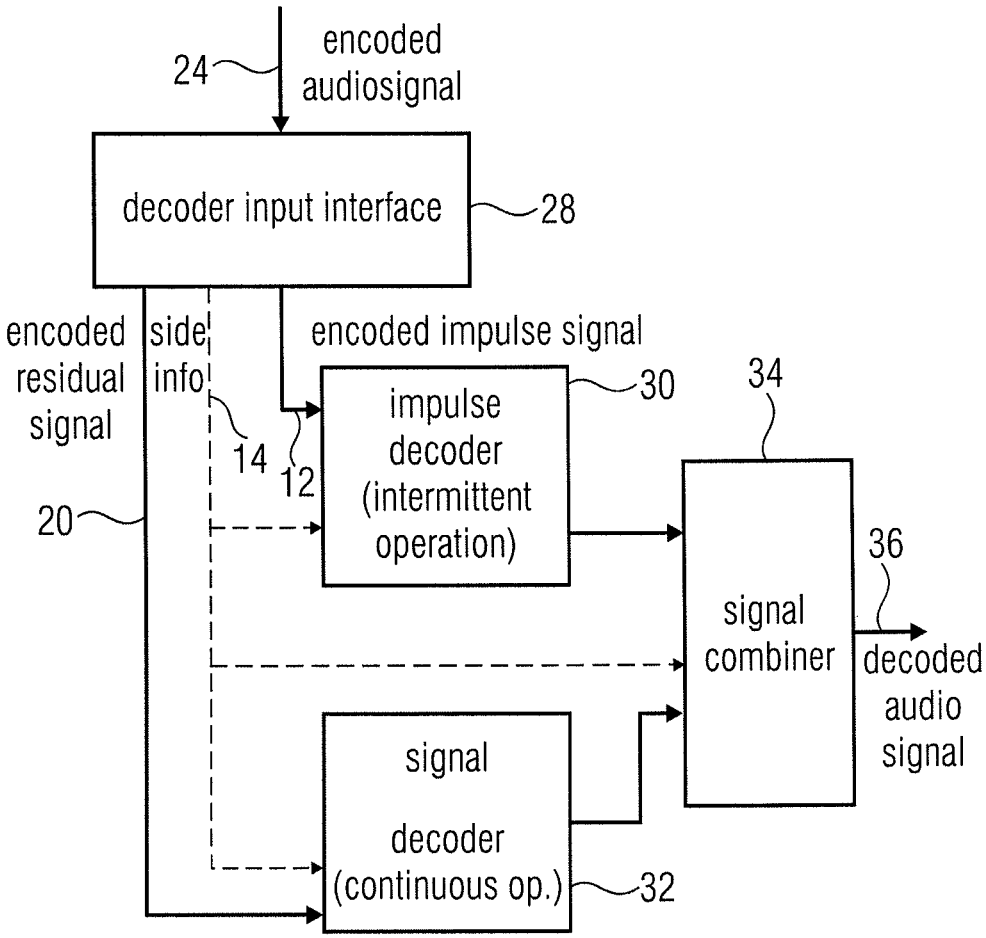
FIG 2 (Decoder)

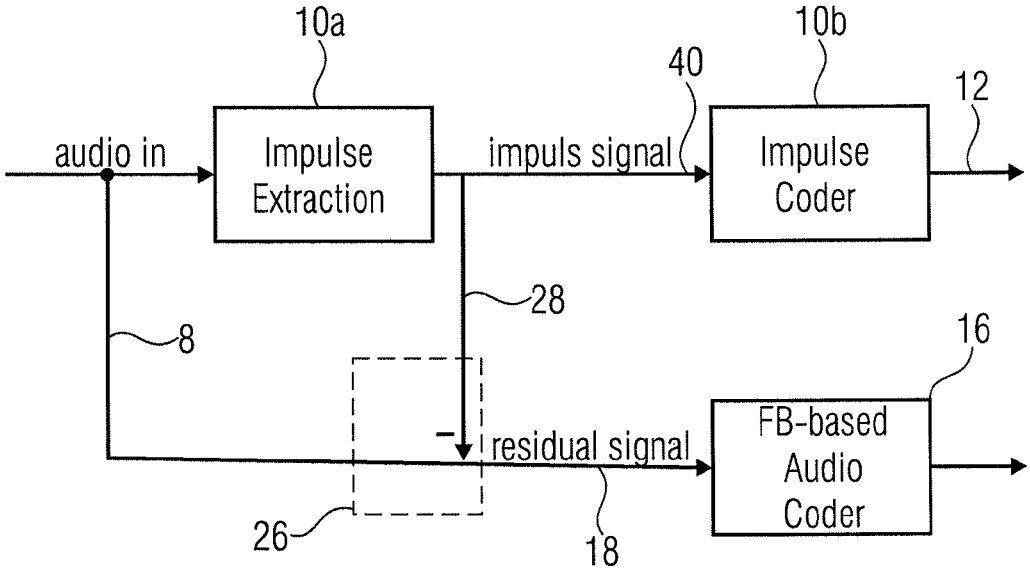
FIG 3A (open loop)
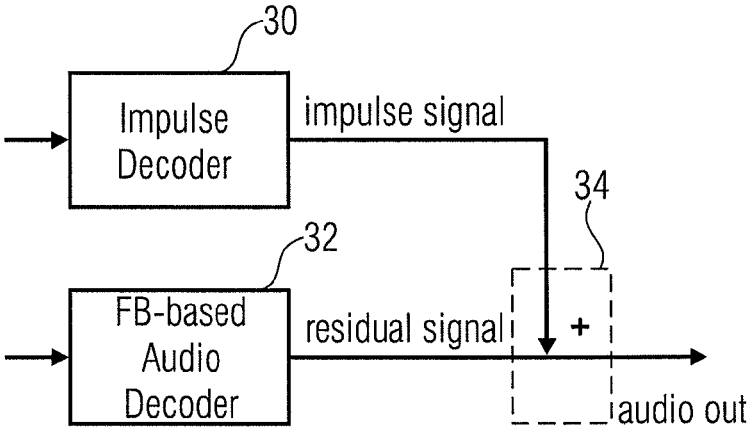
FIG 3B

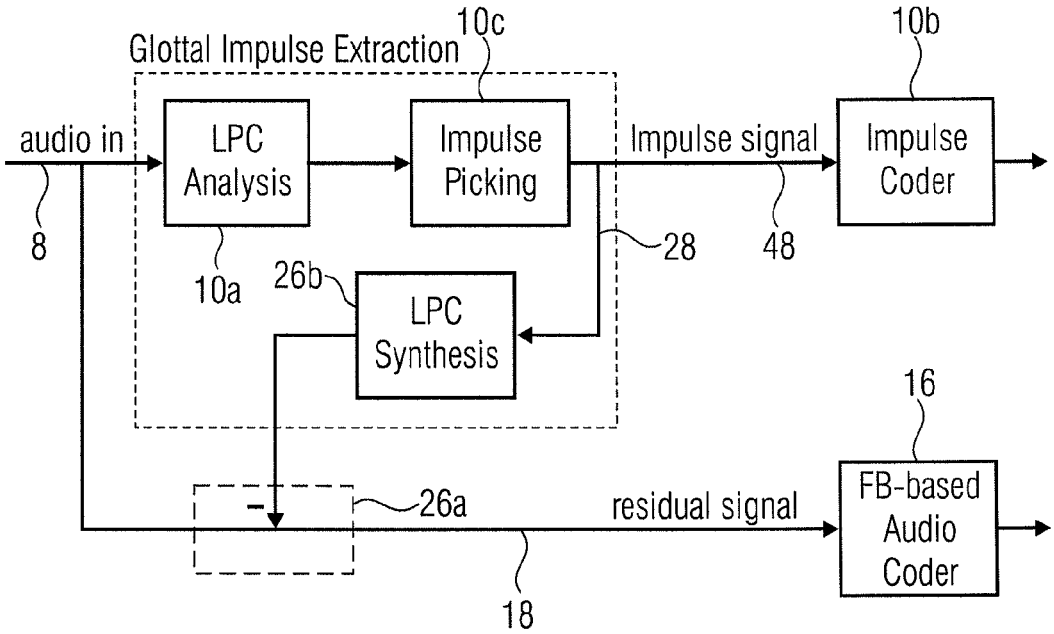
FIG 4A (open loop)
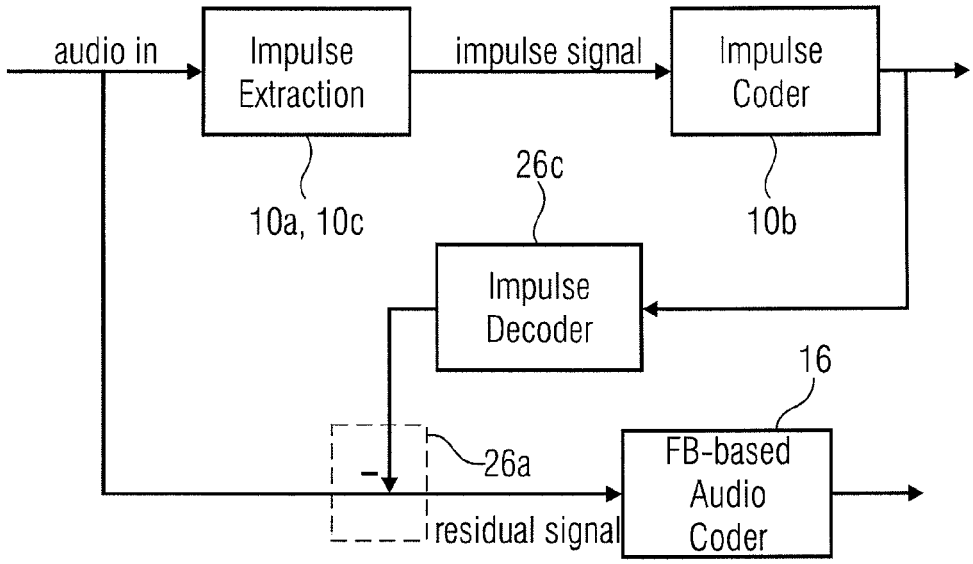
FIG 4B (closed loop)

Impulse-like signal segment (e.g voiced speech)

$A_L$ (z): Long Term Prediction
≙ pitch (fine) structure

A(z): Short Term Prediction
≙ formant structure/spectral envelope

AUDIO ENCODER FOR ENCODING AN AUDIO SIGNAL HAVING AN IMPULSE-LIKE PORTION AND STATIONARY PORTION, ENCODING METHODS, DECODER, DECODING METHOD, AND ENCODING AUDIO SIGNAL

CROSS-REFERENCE TO RELATED APPLICATIONS

This application is a U.S. national entry of PCT Patent Application No. PCT/EP2008/004496 filed Jun. 5, 2008, and claims priority to U.S. Provisional Patent Application No. 60/943,505 filed Jun. 12, 2007 and U.S. Provisional Patent Application No. 60/943,253 filed Jun. 11, 2007, each of which is incorporated herein by reference.

BACKGROUND OF THE INVENTION

The present invention relates to source coding, and particularly, to audio source coding, in which an audio signal is processed by at least two different audio coders having different coding algorithms.

In the context of low bitrate audio and speech coding technology, several different coding techniques have traditionally been employed in order to achieve low bitrate coding of such signals with best possible subjective quality at a given bitrate. Coders for general music/sound signals aim at optimizing the subjective quality by shaping spectral (and temporal) shape of the quantization error according to a masking threshold curve which is estimated from the input signal by means of a perceptual model ("perceptual audio coding"). On the other hand, coding of speech at very low bitrates has been shown to work very efficiently when it is based on a production model of human speech, i.e. employing Linear Predictive Coding (LPC) to model the resonant effects of the human vocal tract together with an efficient coding of the residual excitation signal.

As a consequence of these two different approaches, general audio coders (like MPEG-1 Layer 3, or MPEG-2/4 Advanced Audio Coding, AAC) usually do not perform as well for speech signals at very low data rates as dedicated LPC-based speech coders due to the lack of exploitation of a speech source model. Conversely, LPC-based speech coders usually do not achieve convincing results when applied to general music signals because of their inability to flexibly shape the spectral envelope of the coding distortion according to a masking threshold curve. In the following, embodiments are described which provide a concept that combines the advantages of both LPC-based coding and perceptual audio coding into a single framework and thus describe unified audio coding that is efficient for both general audio and speech signals.

Traditionally, perceptual audio coders use a filterbank-based approach to efficiently code audio signals and shape the quantization distortion according to an estimate of the masking curve.

FIG. 16*a* shows the basic block diagram of a monophonic perceptual coding system. An analysis filterbank 1600 is used to map the time domain samples into subsampled spectral components. Dependent on the number of spectral components, the system is also referred to as a subband coder (small number of subbands, e.g. 32) or a transform coder (large number of frequency lines, e.g. 512). A perceptual ("psychoacoustic") model 1602 is used to estimate the actual time dependent masking threshold. The spectral ("subband" or "frequency domain") components are quantized and coded 1604 in such a way that the quantization noise is hidden under the actual transmitted signal, and is not perceptible after decoding. This is achieved by varying the granularity of quantization of the spectral values over time and frequency.

The quantized and entropy-encoded spectral coefficients or subband values are, in addition with side information, input into a bitstream formatter 1606, which provides an encoded audio signal which is suitable for being transmitted or stored. The output bitstream of block 1606 can be transmitted via the Internet or can be stored on any machine readable data carrier.

On the decoder-side, a decoder input interface 1610 receives the encoded bitstream. Block 1610 separates entropy-encoded and quantized spectral/subband values from side information. The encoded spectral values are input into an entropy-decoder such as a Huffman decoder which is positioned between 1610 and 1620. The output of this entropy decoder is quantized spectral values. These quantized spectral values are input into a re-quantizer which performs an "inverse" quantization as indicated at 1620 in FIG. 16*a*. The output of block 1620 is input into a synthesis filterbank 1622, which performs a synthesis filtering including a frequency/time transform and, typically, a time domain aliasing cancellation operation such as overlap and add and/or a synthesis-side windowing operation to finally obtain the output audio signal.

FIGS. 16*b*, 16*c* indicate an alternative to the entire filterbank based perceptual coding concept of FIG. 16*a*, in which a pre-filtering approach on the encoder-side and a post-filtering approach on the decoder-side are implemented.

In [Edl00], a perceptual audio coder has been proposed which separates the aspects of irrelevance reduction (i.e. noise shaping according to perceptual criteria) and redundancy reduction (i.e. obtaining a mathematically more compact representation of information) by using a so-called pre-filter rather than a variable quantization of the spectral coefficients over frequency. The principle is illustrated in FIG. 16*b*. The input signal is analyzed by a perceptual model 1602 to compute an estimate of the masking threshold curve over frequency. The masking threshold is converted into a set of pre-filter coefficients such that the magnitude of its frequency response is inversely proportional to the masking threshold. The pre-filter operation applies this set of coefficients to the input signal which produces an output signal in which all frequency components are represented according to their perceptual importance ("perceptual whitening"). This signal is subsequently coded by any kind of audio coder 1632 which produces a "white" quantization distortion, i.e. does not apply any perceptual noise shaping. The transmission/storage of the audio signal include both, the coder's bitstream and a coded version of the pre-filtering coefficients. In the decoder of FIG. 16*c*, the coder bitstream is decoded (1634) into the perceptually whitened audio signal which contains additive white quantization noise. This signal is then subjected to a post-filtering operation 1640 according to the transmitted filter coefficients. Since the post-filter performs the inverse filtering process relative to the pre-filter, it reconstructs the original audio input signal from the perceptually whitened signal. The additive white quantization noise is spectrally shaped like the masking curve by the post-filter and thus appears perceptually colored at the decoder output, as intended.

Since in such a scheme perceptual noise shaping is achieved via the pre-/post-filtering step rather than frequency dependent quantization of spectral coefficients, the concept can be generalized to include non-filterbank-based coding mechanism for representing the pre-filtered audio signal rather than a filterbank-based audio coder. In [Sch02] this is shown for time domain coding kernel using predictive and entropy coding stages.

In order to enable appropriate spectral noise shaping by using pre-/post-filtering techniques, it is important to adapt the frequency resolution of the pre-/post-filter to that of the human auditory system. Ideally, the frequency resolution would follow well-known perceptual frequency scales, such as the BARK or ERB frequency scale [Zwi]. This is especially desirable in order to minimize the order of the pre-/post-filter model and thus the associated computational complexity and side information transmission rate.

The adaptation of the pre-/post-filter frequency resolution can be achieved by the well-known frequency warping concept [KHL97]. Essentially, the unit delays within a filter structure are replaced by (first or higher order) allpass filters which leads to a non-uniform deformation ("warping") of the frequency response of the filter. It has been shown that even by using a first-order allpass filter, e.g.

$$\frac{z^{-1}-\lambda}{1-\lambda z^{-1}},$$

a quite accurate approximation of perceptual frequency scales is possible by an appropriate choice of the allpass coefficients [SA99]. Thus, most known systems do not make use of higher-order allpass filters for frequency warping. Since a first-order allpass filter is fully determined by a single scalar parameter (which will be referred to as the "warping factor"$-1<\square<1$), which determines the deformation of the frequency scale. For example, for a warping factor of $\square=0$, no deformation is effective, i.e. the filter operates on the regular frequency scale. The higher the warping factor is chosen, the more frequency resolution is focused on the lower frequency part of the spectrum (as it may be used to approximate a perceptual frequency scale), and taken away from the higher frequency part of the spectrum).

Using a warped pre-/post-filter, audio coders typically use a filter order between 8 and 20 at common sampling rates like 48 kHz or 44.1 kHz [WSKH05].

Several other applications of warped filtering have been described, e.g. modeling of room impulse responses [HKS00] and parametric modeling of a noise component in the audio signal (under the equivalent name Laguerre/Kauz filtering) [SOB03]

Traditionally, efficient speech coding has been based on Linear Predictive Coding (LPC) to model the resonant effects of the human vocal tract together with an efficient coding of the residual excitation signal [VM06]. Both LPC and excitation parameters are transmitted from the encoder to the decoder. This principle is illustrated in FIGS. 17*a* and 17*b*.

FIG. 17*a* indicates the encoder-side of an encoding/decoding system based on linear predictive coding. The speech input is input into an LPC analyzer 1701 which provides, at its output, LPC filter coefficients. Based on these LPC filter coefficients, an LPC filter 1703 is adjusted. The LPC filter outputs a spectrally whitened audio signal which is also termed "prediction error signal". This spectrally whitened audio signal is input into a residual/excitation coder 1705 which generates excitation parameters. Thus, the speech input is encoded into excitation parameters on the one hand, and LPC coefficients on the other hand.

On the decoder-side illustrated in FIG. 17*b*, the excitation parameters are input into an excitation decoder 1707 which generates an excitation signal which can be input into an inverse LPC filter. The inverse LPC filter is adjusted using the transmitted LPC filter coefficients. Thus, the inverse LPC filter 1709 generates a reconstructed or synthesized speech output signal.

Over time, many methods have been proposed with respect to an efficient and perceptually convincing representation of the residual (excitation) signal, such as Multi-Pulse Excitation (MPE), Regular Pulse Excitation (RPE), and Code-Excited Linear Prediction (CELP).

Linear Predictive Coding attempts to produce an estimate of the current sample value of a sequence based on the observation of a certain number of past values as a linear combination of the past observations. In order to reduce redundancy in the input signal, the encoder LPC filter "whitens" the input signal in its spectral envelope, i.e. it is a model of the inverse of the signal's spectral envelope. Conversely, the decoder LPC filter is a model of the signal's spectral envelope. Specifically, the well-known auto-regressive (AR) linear predictive analysis is known to model the signal's spectral envelope by means of an all-pole approximation.

Typically, narrow band speech coders (i.e. speech coders with a sampling rate of 8 kHz) employ an LPC filter with an order between 8 and 12. Due to the nature of the LPC filter, a uniform frequency resolution is effective across the full frequency range. This does not correspond to a perceptual frequency scale.

Noticing that a non-uniform frequency sensitivity, as it is offered by warping techniques, may offer advantages also for speech coding, there have been proposals to substitute the regular LPC analysis by warped predictive analysis, e.g. [TMK94] [KTK95]. Other combinations of warped LPC and CELP coding are known, e.g. from [HLM99].

In order to combine the strengths of traditional LPC/CELP-based coding (best quality for speech signals) and the traditional filterbank-based perceptual audio coding approach (best for music), a combined coding between these architectures has been proposed. In the AMR-WB+ coder [BLS05] two alternate coding kernels operate on an LPC residual signal. One is based on ACELP (Algebraic Code Excited Linear Prediction) and thus is extremely efficient for coding of speech signals. The other coding kernel is based on TCX (Transform Coded Excitation), i.e. a filterbank based coding approach resembling the traditional audio coding techniques in order to achieve good quality for music signals. Depending on the characteristics of the input signal signals, one of the two coding modes is selected for a short period of time to transmit the LPC residual signal. In this way, frames of 80 ms duration can be split into subframes of 40 or 20 ms in which a decision between the two coding modes is made.

A limitation of this approach is that the process is based on a hard switching decision between two coders/coding schemes which possess extremely different characteristics regarding the type of introduced coding distortion. This hard switching process may cause annoying discontinuities in perceived signal quality when switching from one mode to another. For example, when a speech signal is slowly cross-faded into a music signal (such as after an announcement in a broadcasting program), the point of switching may be detectable. Similarly, for speech over music (like for announcements with music background), the hard switching may become audible. With this architecture, it is thus hard to obtain a coder which can smoothly fade between the characteristics of the two component coders.

Recently, also a combination of switched coding has been described that permits the filterbank-based coding kernel to operate on a perceptually weighted frequency scale by fading the coder's filter between a traditional LPC mode (as it is appropriate for CELP-based speech coding) and a warped mode which resembles perceptual audio coding based on pre-/post-filtering as discussed on EP 1873754.

Using a filter with variable frequency warping, it is possible to build a combined speech/audio coder which achieves both high speech and audio coding quality in the following way as indicated in FIG. 17*c:*

The decision about the coding mode to be used ("Speech mode" or "Music mode") is performed in a separate module 1726 by carrying out an analysis of the input signal and can be based on known techniques for discriminating speech signals from music. As a result, the decision module produces a decision about the coding mode/and an associated optimum warping factor for the filter 1722. Furthermore, depending on this decision, it determines a set of suitable filter coefficients which are appropriate for the input signal at the chosen coding mode, i.e. for coding of speech, an LPC analysis is performed (with no warping, or a low warping factor) whereas for coding of music, a masking curve is estimated and its inverse is converted into warped spectral coefficients.

The filter 1722 with the time varying warping characteristics is used as a common encoder/decoder filter and is applied to the signal depending on the coding mode decision/warping factor and the set of filter coefficients produced by the decision module.

The output signal of the filtering stage is coded by either a speech coding kernel 1724 (e.g. CELP coder) or a generic audio coder kernel 1726 (e.g. a filterbank-based coder, or a predictive audio coder), or both, depending on the coding mode.

The information to be transmitted/stored comprises the coding mode decision (or an indication of the warping factor), the filter coefficients in some coded form, and the information delivered by the speech/excitation and the generic audio coder.

In the corresponding decoder, the outputs of the residual/excitation decoder and the generic audio decoder are added up and the output is filtered by the time varying warped synthesis filter, based on the coding mode, warping factor and filter coefficients.

Due to the hard switching decision between two coding modes, the scheme is, however, still subject to similar limitations as the switched CELP/filterbank-based coding as they were described previously. With this architecture, it is hard to obtain a coder which can smoothly fade between the characteristics of the two component coders.

Another way of combining a speech coding kernel with a generic perceptual audio coder is used for MPEG-4 Large-Step Scalable Audio Coding [Gri97] [Her02]. The idea of scalable coding is to provide coding/decoding schemes and bitstream formats that allow meaningful decoding of subsets of a full bitstream, resulting in a reduced quality output signal. In this, the transmitted/decoded data rate can be adapted to the instantaneous transmission channel capacity without a re-encoding of the input signal.

The structure of an MPEG-4 large-step scalable audio coder is depicted by FIG. 18 [Gri97]. This configuration comprises both a so-called core coder 1802 and several enhancement layers based on perceptual audio coding modules 1804. The core coder (typically a narrow band speech coder) operates at a lower sampling rate than the subsequent enhancement layers. The scalable combination of these components works as follows:

The input signal is down-sampled 1801 and encoded by the core coder 1802. The produced bitstream constitutes the core layer portion 1804 of the scalable bitstream. It is decoded locally 1806 and upsampled 1808 to match the sampling rate of the perceptual enhancement layers and passed through the analysis filterbank (MDCT) 1810.

In a second signal path, the delay (1812) compensated input signal is passed through the analysis filterbank 1814 and used to compute the residual coding error signal.

The residual signal is passed through a Frequency Selective Switch (FSS) tool 1816 which permits to fall back to the original signal on a scalefactor band basis if this can be coded more efficiently than the residual signal.

The spectral coefficients are quantized/coded by an AAC coding kernel 1804, leading to an enhancement layer bitstream 1818.

Further stages of refinement (enhancement layers) by re-coding of the residual coding error signal can follow.

FIG. 19 illustrates the structure of the associated core-based scalable decoder. The composite bit-stream is decomposed 1902 into the individual coding layers. Decoding 1904 of the core coder bitstream (e.g. a speech coder bitstream) is then performed and its output signal may be presented via an optional post filter stage. In order to use the core decoder signal within the scalable decoding process, it is upsampled 1908 to the sampling rate of the scalable coder, delay compensated 1910 with respect to the other layers and de-composed by the coder analysis filterbank (MDCT) 1912.

Higher layer bitstreams are then decoded 1916 by applying the AAC noiseless decoding and inverse quantization, and summing up 1918 all spectral coefficient contributions. A Frequency Selective Switch tool 1920 combines the resulting spectral coefficients with the contribution from the core layer by selecting either the sum of them or only the coefficients originating from the enhancement layers as signaled from the encoder. Finally, the result is mapped back to a time domain representation by the synthesis filterbank (IMDCT) 1922.

As a general characteristic, the speech coder (core coder) is used and decoded in this configuration. Only if a decoder has access not only to the core layer of the bitstream but also to one or more enhancement layers, also contributions from the perceptual audio coders in the enhancement layers are transmitted which can provide a good quality for non-speech/music signals.

Consequently, this scalable configuration includes an active layer containing a speech coder which leads to some drawbacks regarding its performance to provide best overall quality for both speech and audio signals:

If the input signal is a signal that predominantly consists of speech, the perceptual audio coder in the enhancement layer(s) code a residual/difference signal that has properties that may be quite different from that of regular audio signals and are thus hard to code for this type of coder. As one example, the residual signal may contain components which are impulsive of nature and therefore provoke pre-echoes when coded with a filterbank-based perceptual audio coder.

If the input signal is not predominantly speech, the residual signal frequently necessitates more bitrate to code than the input signal. In these cases, the FSS selects the original signal for coding by the enhancement layer rather than the residual signal. Consequently, the core layer does not contribute to the output signal and the bitrate of the core layer is spent in vain since it does not contribute to an improvement of the overall quality. In other words, in such cases the result sounds worse that if the entire bitrate would have simply been allocated to a perceptual audio coder only.

In http://www.hitech-projects.com/euprojects/ardor/summary.htm
the ARDOR (Adaptive Rate-Distortion Optimised sound codeR) codec is described as follows:

Within the project, a codec is created that encodes generic audio with the most appropriate combination of signal models, given the imposed constraints as well as the available subcoders. The work can be divided into three parts corresponding to the three codec components as illustrated in FIG. 20.

A rate-distortion-theory based optimization mechanism 2004 that configures the ARDOR codec such that it operates most efficiently given the current, time-varying, constraints and type of input signal. For this purpose it controls: a set of 'subcoding' strategies 2000, each of which is highly efficient for encoding a particular type of input-signal component, e.g., tonal, noisy, or transient signals. The appropriate rate and signal-component allocation for each particular subcoding strategy is based on: an advanced, new perceptual distortion measure 2002 that provides a perceptual criterion for the rate-distortion optimization mechanism. In other words, a perceptual model, which is based on state-of-the-art knowledge about the human auditory system, provides the optimization mechanism with information about the perceptual relevance of different parts of the sound. The optimization algorithm could for example decide to leave out information that is perceptually irrelevant. Consequently, the original signal cannot be restored, but the auditory system will not be able to perceive the difference.

The above discussion of several known systems underlines that there does not yet exist an optimum encoding strategy which, on the one hand provides optimum quality for general audio signals as well as speech signals, and which on the other hand, provides a low bitrate for all kinds of signals. Particularly, the scalable approach as discussed in connection with FIG. 18 and FIG. 19 which has been standardized in MPEG-4 continuously processes the whole audio signal using a speech coder core without paying attention to the audio signal and, specifically, to the source of the audio signal. Therefore, when the audio signal is not speech-like, the core encoder will introduce heavy coding artifacts and, consequently, the frequency selective switch tool 1816 in FIG. 18 will make sure that the full audio signal is encoded using the AAC encoder core 1804. Thus, in this instance, the bitstream includes the useless output of the speech core coder, and additionally includes the perceptually encoded representation of the audio signal. This not only results in a waste of transmission bandwidth, but also results in a high and useless power consumption, which is particularly problematic when the encoding concept is to be implemented in mobile devices which are battery-powered and have limited resources of energy.

Generally stated, the transform-based perceptual encoder operates without paying attention to the source of the audio signal, which results in the fact that, for all available sources of signals, the perceptual audio encoder (when having a moderate bit rate) can generate an output without too many coding artifacts, but for non-stationary signal portions, the bitrate increases, since the masking threshold does not mask as efficient as in stationary sounds. Furthermore, the inherent compromise between time resolution and frequency resolution in transform-based audio encoders renders this coding system problematic for transient or impulse-like signal components, since these signal components would necessitate a high time resolution and would not necessitate a high frequency resolution.

The speech coder, however, is a prominent example for a coding concept, which is heavily based on a source model. Thus, a speech coder resembles a model of the speech source, and is, therefore, in the position to provide a highly efficient parametric representation for signals originating from a sound source similar to the source model represented by the coding algorithm. For sounds originating from sources which do not coincide with the speech coder source model, the output will include heavy artifacts or, when the bitrate is allowed to increase, will show up a bitrate which is drastically increased and substantially higher than a bitrate of a general audio coder.

SUMMARY

According to an embodiment, an audio encoder for encoding an audio signal having an impulse-like portion and a stationary portion may have: an impulse extractor for extracting the impulse-like portion from the audio signal, the impulse-extractor having an impulse coder for encoding the impulse-like portions to obtain an encoded impulse-like signal; a signal encoder for encoding a residual signal derived from the audio signal to obtain an encoded residual signal, the residual signal being derived from the audio signal so that the impulse-like portion is reduced or eliminated from the audio signal; and an output interface for outputting the encoded impulse-like signal and the encoded residual signal, to provide an encoded signal, wherein the impulse encoder is configured for not providing an encoded impulse-like signal, when the impulse extractor is not able to find an impulse portion in the audio signal.

According to another embodiment, a method of encoding an audio signal having an impulse-like portion and a stationary portion may have the steps of: extracting the impulse-like portion from the audio signal, the step of extracting having a step of encoding the impulse-like portions to obtain an encoded impulse-like signal; encoding a residual signal derived from the audio signal to obtain an encoded residual signal, the residual signal being derived from the audio signal so that the impulse-like portion is reduced or eliminated from the audio signal; and outputting, by transmitting or storing, the encoded impulse-like signal and the encoded residual signal, to provide an encoded signal, wherein the step of impulse encoding is not performed, when the step of impulse-extracting does not find an impulse portion in the audio signal.

According to still another embodiment, a decoder for decoding an encoded audio signal having an encoded impulse-like signal and an encoded residual signal may have: an impulse decoder for decoding the encoded impulse-like signal using a decoding algorithm adapted to a coding algorithm used for generating the encoded impulse-like signal, wherein a decoded impulse-like signal is obtained; a signal decoder for decoding the encoded residual signal using a decoding algorithm adapted to a coding algorithm used for generating the encoded residual signal, wherein a decoded residual signal is obtained; and a signal combiner for combining the decoded impulse-like signal and the decoded residual signal to provide a decoded output signal, wherein the signal decoder and the impulse decoder are operative to provide output values related to the same time instant of a decoded signal, wherein the impulse decoder is operative to receive the encoded impulse-like signal and provide the decoded impulse-like signal at specified time portions separated by periods in which the signal decoder provides the decoded residual signal and the impulse decoder does not provide the decoded impulse-like signal, so that the decoded output signal has the periods in which the decoded output signal is identical to the decoded residual signal and the decoded output signal has the specified time portions in which the decoded output signal consists of the decoded residual signal and the decoded impulse-like signal or consists of the decoded impulse-like signal only.

According to still another embodiment, a method of decoding an encoded audio signal having an encoded impulse-like signal and an encoded residual signal may have the steps of: decoding the encoded impulse-like signal using a decoding algorithm adapted to a coding algorithm used for generating the encoded impulse-like signal, wherein a decoded impulse-like signal is obtained; decoding the encoded residual signal using a decoding algorithm adapted to a coding algorithm used for generating the encoded residual signal, wherein a decoded residual signal is obtained; and combining the decoded impulse-like signal and the decoded residual signal to provide a decoded output signal, wherein the steps of decoding are operative to provide output values related to the same time instant of a decoded signal, wherein, in the step of decoding the encoded impulse-like signal, the encoded impulse-like signal is received and the decoded impulse-like signal is provided at specified time portions separated by periods in which the step of decoding the encoded residual signal provides the decoded residual signal and the step of decoding the encoded impulse-like signal does not provide the decoded impulse-like signal, so that the decoded output signal has the periods, in which the decoded output signal is identical to the decoded residual signal and the decoded output signal has the specified time portions in which the decoded output signal consists of the decoded residual signal and the decoded impulse-like signal or consists of the impulse-like signal only.

Another embodiment may have an encoded audio signal having an encoded impulse-like signal, an encoded residual signal, and side information indicating information relating to an encoding or decoding characteristic pertinent to the encoded residual signal or the encoded impulse-like signal, wherein the encoded impulse-like signal represents specified time portions of the audio signal, in which the audio signal is represented by the encoded impulse-like signal only or is represented by the encoded residual signal and the encoded impulse-like signal, the specified time portions being separated by periods, in which the audio signal is only represented by the encoded residual signal and not by the encoded impulse-like signal.

Another embodiment may have a computer program having a program code adapted for performing the above method of encoding an audio signal having an impulse-like portion and a stationary portion, when running on a processor.

Another embodiment may have a computer program having a program code adapted for performing the above method of decoding an encoded audio signal having an encoded impulse-like signal and an encoded residual signal, when running on a processor.

The present invention is based on the finding that a separation of impulses from an audio signal will result in a highly efficient and high quality audio encoding concept. By extracting impulses from the audio signal, an impulse audio signal on the one hand and a residual signal corresponding to the audio signal without the impulses is generated. The impulse audio signal can be encoded by an impulse coder such as a highly efficient speech coder, which provides extremely low data rates at a high quality for speech signals. On the other hand, the residual signal is freed of its impulse-like portion and is mainly constituted of the stationary portion of the original audio signal. Such a signal is very well suited for a signal encoder such as a general audio encoder and, advantageously, a transform-based perceptually controlled audio encoder. An output interface outputs the encoded impulse-like signal and the encoded residual signal. The output interface can output these two encoded signals in any available format, but the format does not have to be a scalable format, due to the fact that the encoded residual signal alone, or the encoded impulse-like signal alone, may under special circumstances not be of significant use by itself. Only both signals together will provide a high quality audio signal.

On the other hand, however, the bitrate of this combined encoded audio signal can be controlled to a high degree, when a fixed rate impulse coder such as an CELP or ACELP encoder is used, which can be tightly controlled with respect to its bitrate. On the other hand, the signal encoder is, when for example, implemented as an MP3 or MP4 encoder, controllable so that it outputs a fixed bitrate, although performing a perceptual coding operation which inherently outputs a variable bitrate, based on an implementation of a bit reservoir as known in the art for MP3 or MP4 coders. This will make sure that the bitrate of the encoded output signal is a constant bitrate.

Due to the fact that the residual audio signal does not include the problematic impulse-like portions anymore, the bitrate of the encoded residual signal will be low, since this residual signal is optimally suited for the signal encoder.

On the other hand, the impulse encoder will provide an excellent and efficient operation, since the impulse encoder is fed with a signal which is specifically shaped and selected from the audio signal to fit perfectly to the impulse coder source model. Thus, when the impulse extractor is not able to find impulse portions in the audio signal, then the impulse encoder will not be active and will not try to encode any signal portions which are not at all suitable for being coded with the impulse coder. In view of this, the impulse coder will also not provide an encoded impulse signal and will also not contribute to the output bitrate for signal portions where the impulse coder would necessitate a high bitrate or would not be in the position to provide an output signal having an acceptable quality. Specifically, for mobile applications, the impulse coder will also not require any energy resources in such a situation. Thus, the impulse coder will only become active when the audio signal includes an impulse-like portion and the impulse-like portion extracted by the impulse extractor will also be perfectly in line with what the impulse encoder expects.

Thus, the distribution of the audio signal to two different coding algorithms will result in a combined coding operation, which is specifically useful in that the signal encoder will be continuously active and the impulse coder will work as a kind of a fallback module, which is only active and only produces output bits and only consumes energy, if the signal actually includes impulse-like portions.

Advantageously, the impulse coder is adapted for advantageously encoding sequences of impulses which are also called "impulse trains" in the art. Theses "pulses" or "impulse trains" are typical pattern obtained by modeling the human vocal tract. A pulse train has impulses at time-distances between adjacent impulses. Such a time distance is called a "pitch lag", and this value corresponds with the "pitch frequency".

BRIEF DESCRIPTION OF THE DRAWINGS

Embodiments of the present invention are subsequently discussed in connection with the accompanying drawings, in which:

FIG. 1 is a block diagram of an audio encoder in accordance with an embodiment of the present invention;

FIG. 2 is a block diagram of a decoder for decoding an encoded audio signal;

FIG. 3*a* illustrates an open-loop embodiment;

FIG. 3*b* illustrates a specific embodiment of a decoder;

FIG. 4*a* illustrates another open-loop embodiment of the encoder-side;

FIG. 4*b* illustrates a closed-loop embodiment of the encoder-side;

DETAILED DESCRIPTION OF THE INVENTION

Figure 4C:
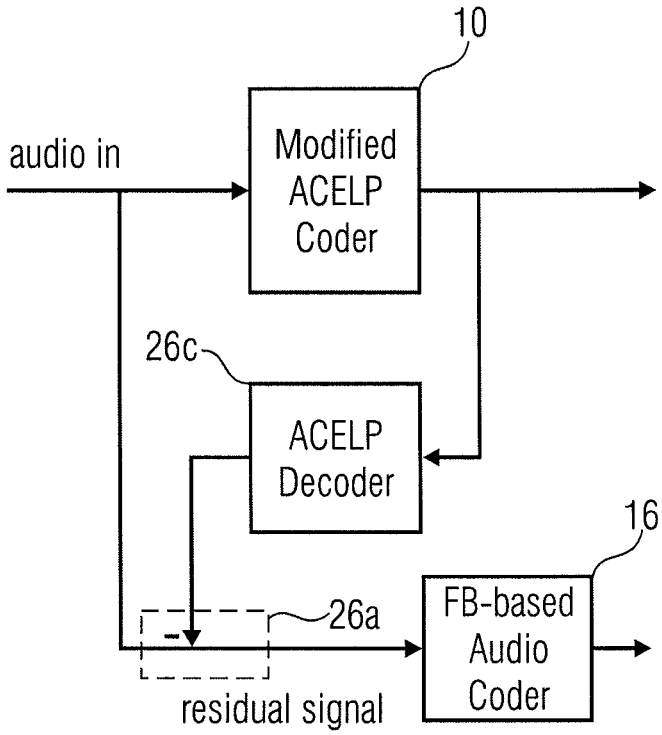
FIG. 4*c* illustrates an embodiment in which the impulse extractor and the impulse coder are implemented within a modified ACELP coder.

It is an advantage of the following embodiments to provide a unified method that extends a perceptual audio coder to allow coding of not only general audio signals with optimal quality, but also provide significantly improved coded quality for speech signals. Furthermore, they enable the avoidance of problems associated with a hard switching between an audio coding mode (e.g. based on a filterbank) and a speech coding mode (e.g. based on the CELP approach) that were described previously. Instead, below embodiments allow for a smooth/continuous combined operation of coding modes and tools, and in this way achieves a more graceful transition/blending for mixed signals.

The following considerations form a basis for the following embodiments:

Common perceptual audio coders using filterbanks are well-suited to represent signals that may have considerable fine structure across frequency, but are rather stationary over time. Coding of transient or impulse-like signals by filterbank-based coders results in a smearing of the coding distortion over time and thus can lead to pre-echo artifacts.

A significant part of speech signals consists of trains of impulses that are produced by the human glottis during voiced speech with a certain pitch frequency. These pulse train structures are therefore difficult to code by filterbank-based perceptual audio coders at low bitrates.

Thus, in order to achieve optimum signal quality with a filterbank-based coding system, it is advantageous to decompose the coder input signal into impulse-like structures and other, more stationary components. The impulse-like structures may be coded with a dedicated coding kernel (hereafter referred to as the impulse coder) whereas the other residual components may be coded with the common filterbank-based perceptual audio coder (hereafter referred to as the residual coder). The pulse coder is advantageously constructed from functional blocks from traditional speech coding schemes, such as an LPC filter, information on pulse positions etc. and may employ techniques such as excitation codebooks, CELP etc.

The separation of the coder input signal may be carried out such that two conditions are met:

(Condition #1) Impulse-like signal characteristics for impulse coder input: Advantageously, the input signal to the impulse coder only comprises impulse-like structures in order to not generate undesired distortion since the impulse coder is especially optimized to transmit impulsive structures, but not stationary (or even tonal) signal components. In other words, feeding tone-like signal components into the impulse coder will lead to distortions which cannot be compensated easily by the filterbank-based coder.

(Condition #2) Temporally smooth impulse coder residual for the residual coder: The residual signal which is coded by the residual coder is generated such that after the split of the input signal, the residual signal is stationary over time, even at time instances where pulses are coded by the pulse coder. Specifically, it is of advantage that no "holes" in the temporal envelope of the residual are generated.

In contrast to the aforementioned switched coding schemes, a continuous combination between impulse coding and residual coding is achieved by having coders (the impulse coder and the residual coder) and their associated decoders run in parallel, i.e. simultaneously, if the need arises. Specifically, in an advantageous way of operation, the residual coder is operational, while the impulse coder is only activated when its operation is found to be beneficial.

A part of the proposed concept is to split the input signal into partial input signals that are optimally adapted to the characteristics of each partial coder (impulse coder and residual coder) in order to achieve optimum overall performance. In the following embodiments, the following is assumed.

One partial coder is a filterbank-based audio coder (similar to common perceptual audio coders). As a consequence, this partial coder is well-suited to process stationary and tonal audio signals (which in a spectrogram representation correspond to "horizontal structures"), but not to audio signals which contain many instationarities over time, such as transients, onsets or impulses (which in a spectrogram representation correspond to "vertical structures"). Trying to encode such signals with the filterbank-based coder will lead to temporal smearing, pre-echoes and a reverberant characteristic of the output signal.

The second partial coder is an impulse coder which is working in the time domain. As a consequence, this partial coder is well-suited to process audio signals which contain many instationarities over time, such as transients, onsets or impulses (which in a spectrogram representation correspond to "vertical structures"), but not to represent stationary and tonal audio signals (which in a spectrogram representation correspond to "horizontal structures"). Trying to encode such signals with the time-domain impulse coder will lead to distortions of tonal signal components or harsh sounding textures due to the underlying sparse time domain representation.

The decoded output of both the filterbank-based audio decoder and the time-domain impulse decoder are summed up to form the overall decoded signal (if both the impulse and the filterbank-based coder are active at the same time).

FIG. 1 illustrates an audio encoder for encoding an audio signal 10 having an impulse-like portion and a stationary portion. Generally, a differentiation between an impulse-like portion of an audio signal and a stationary portion of a stationary signal can be made by applying a signal processing operation, in which the impulse-like characteristic is measured and the stationary-like characteristic is measured as well. Such measurements can, for example, be done by analyzing the wave form of the audio signal. To this end, any transform-based processing or LPC processing or any other processing can be performed. An intuitive way of determining as to whether a portion is impulse-like or not is for example to look at a time domain wave form and to determine whether this time domain wave form has peaks at regular or irregular intervals, and peaks in regular intervals are even more suited for a speech-like coder.

Figure 5B:
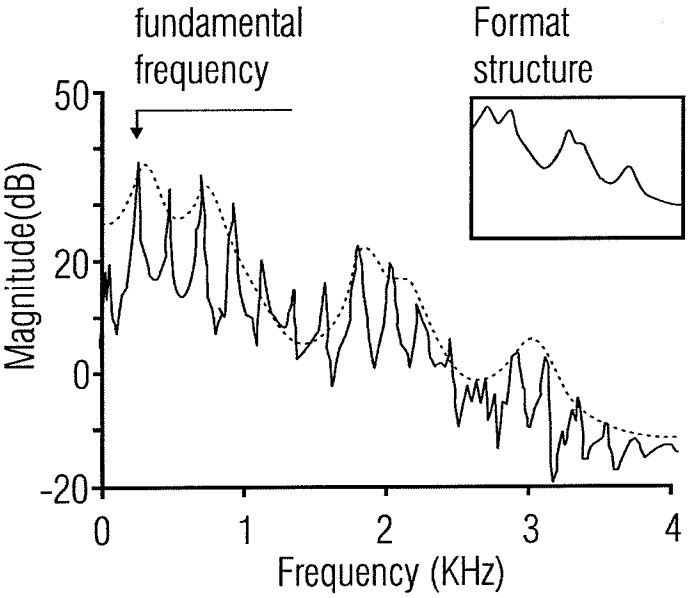
FIG. 5*b* illustrates a spectrum of the segment of FIG. 5*a;*
Figure 5A:
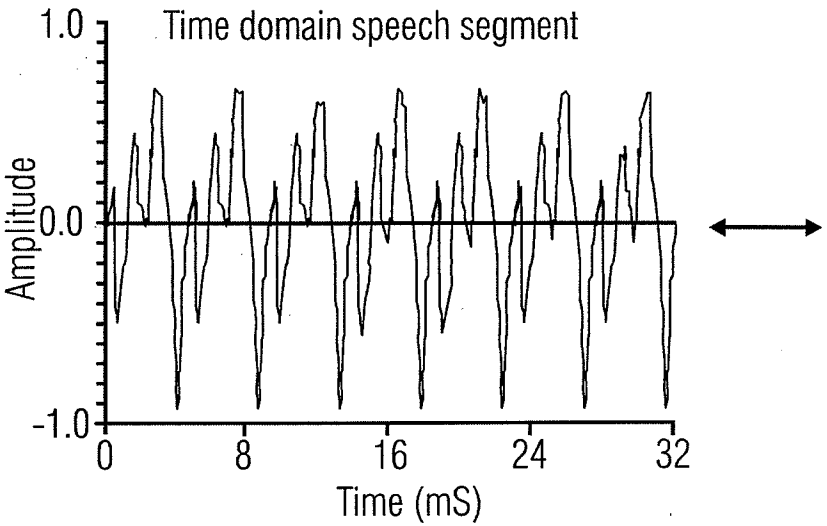
FIG. 5*a* illustrates a wave form of a time domain speech segment as an impulse-like signal segment.

Exemplarily, reference is made to FIGS. 5*a* to 5*d*. Here, impulse-like signal segments or signal portions and stationary signal segments or signal portions are exemplarily discussed. Specifically, a voiced speech as illustrated in FIG. 5*a* in the time domain and in FIG. 5*b* in the frequency domain is discussed as an example for an impulse-like signal portion, and an unvoiced speech segment as an example for a stationary signal portion is discussed in connection with FIGS. 5*c* and 5*d*. Speech can generally be classified as voiced, unvoiced, or mixed. Time-and-frequency domain plots for sampled voice and unvoiced segments are shown in FIGS. 5*a* to 5*d*. Voiced speech is quasi periodic in the time domain and harmonically structured in the frequency domain, while unvoiced speed is random-like and broadband. In addition, the energy of voiced segments is generally higher than the energy of unvoiced segments. The short-time spectrum of voiced speech is characterized by its fine and formant structure. The fine harmonic structure is a consequence of the quasi-periodicity of speech and may be attributed to the vibrating vocal chords. The formant structure (spectral envelope) is due to the interaction of the source and the vocal tracts. The vocal tracts consist of the pharynx and the mouth cavity. The shape of the spectral envelope that "fits" the short time spectrum of voiced speech is associated with the transfer characteristics of the vocal tract and the spectral tilt (6 dB/Octave) due to the glottal pulse. The spectral envelope is characterized by a set of peaks which are called formants. The formants are the resonant modes of the vocal tract. For the average vocal tract there are three to five formants below 5 kHz. The amplitudes and locations of the first three formants, usually occurring below 3 kHz are quite important both, in speech synthesis and perception. Higher formants are also important for wide band and unvoiced speech representations. The properties of speech are related to the physical speech production system as follows. Voiced speech is produced by exciting the vocal tract with quasi-periodic glottal air pulses generated by the vibrating vocal chords. The frequency of the periodic pulse is referred to as the fundamental frequency or pitch. Unvoiced speech is produced by forcing air through a constriction in the vocal tract. Nasal sounds are due to the acoustic coupling of the nasal tract to the vocal tract, and plosive sounds are produced by abruptly releasing the air pressure which was built up behind the closure in the tract.

Figures 5C, 5D:
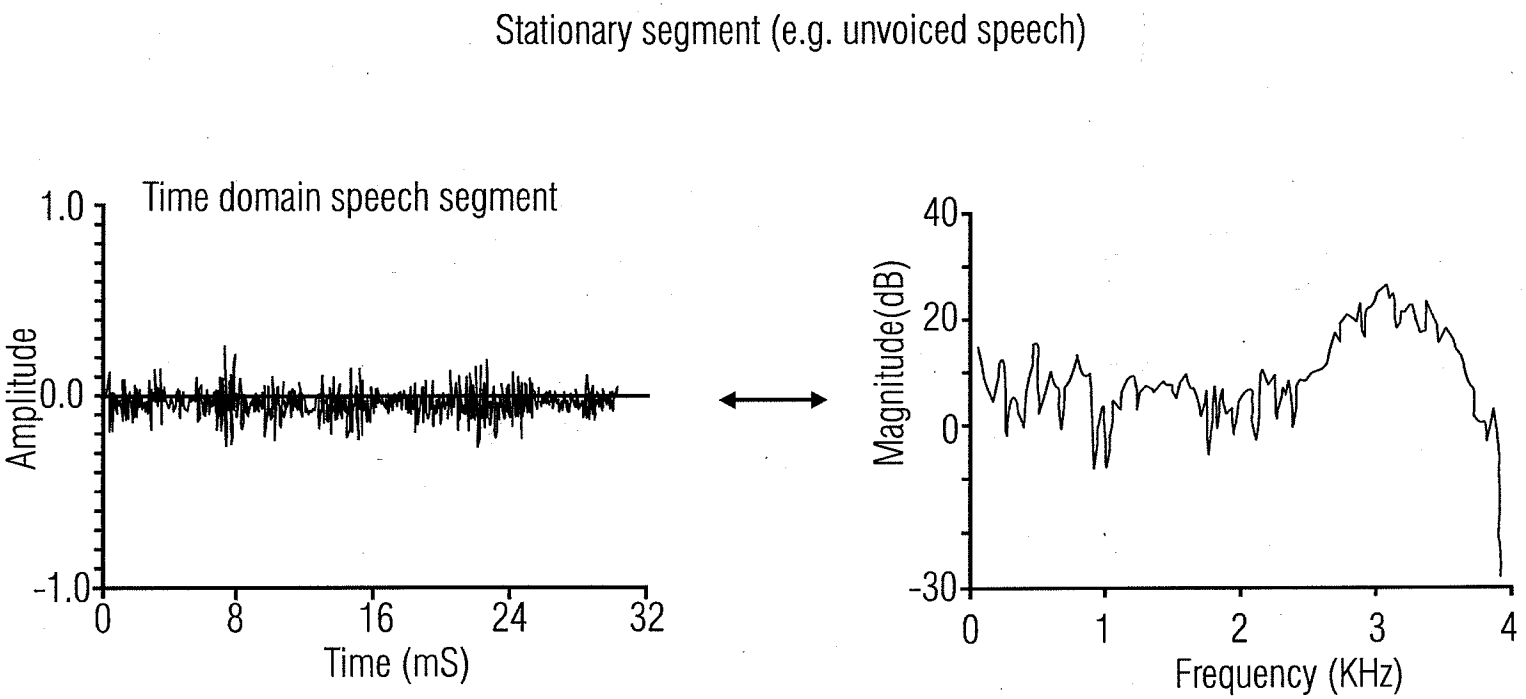
FIG. 5*c* illustrates a time domain speech segment of unvoiced speech as an example for a stationary segment.
FIG. 5*d* illustrates a spectrum of the time domain wave form of FIG. 5*c;*

Thus, a stationary portion of the audio signal can be a stationary portion in the time domain as illustrated in FIG. 5*c* or a stationary portion in the frequency domain, which is different from the impulse-like portion as illustrated for example in FIG. 5*a*, due to the fact that the stationary portion in the time domain does not show prominent repeating pulses. As will be outlined later on, however, the differentiation between stationary portions and impulse-like portions can also be performed using LPC methods, which model the vocal tract and the excitation of the vocal tracts. When the frequency domain representation of the signal is considered, impulse-like signals show the prominent occurrence of the individual formants, i.e., the prominent peaks in FIG. 5*b*, while a stationary spectrum has quite a white spectrum as illustrated in FIG. 5*d*, or in the case of harmonic signals, quite a continuous noise floor having some prominent peaks representing specific tones which occur, for example, in the music signal, but which do not have such a regular distance from each other as the impulse-like signal in FIG. 5*b*.

Furthermore, impulse-like portions and stationary portions can occur in a timely manner, i.e., which means that a portion of the audio signal in time is stationary and another portion of the audio signal in time is impulse-like. Alternatively, or additionally, the characteristic of a signal can be different in different frequency bands. Thus, the determination, whether the audio signal is stationary or impulse-like, can also be performed frequency-selective so that a certain frequency band or several certain frequency bands are considered to be stationary and other frequency bands are considered to be impulse-like. In this case, a certain time portion of the audio signal might include an impulse-like portion and a stationary portion.

The FIG. 1 encoder embodiment includes an impulse extractor 10 for extracting the impulse-like portion from the audio signal. The impulse extractor 10 includes an impulse coder for encoding the impulse-like portion to obtain an encoded impulse-like signal. As will be shown later on, the impulse extraction and the actual encoding operation can be separated from each other, or can be combined so that one obtains a single algorithm such as the ACELP algorithm in its modified form as discussed in connection with FIG. 4*c*.

The output of the impulse extractor 10 is an encoded impulse signal 12 and, in some embodiments, additional side information relating to the kind of impulse extraction or the kind of impulse encoding.

The FIG. 1 encoder embodiment furthermore includes a signal encoder 16 for encoding a residual signal 18 derived from the audio signal 10 to obtain an encoded residual signal 20. Specifically, the residual signal 18 is derived from the audio signal 10 so that the impulse-like portions in the audio signal are reduced or completely eliminated from the audio signal. Nevertheless, the audio signal still includes the stationary portion, since the stationary portion has not been extracted by the impulse extractor 10.

Furthermore, the inventive audio encoder includes an output interface 22 for outputting the encoded impulse signal 12, the encoded residual signal 20 and, if available, the side information 14 to obtain an encoded signal 24. The output interface 22 does not have to be a scalable datastream interface producing a scalable datastream which is written in a manner that the encoded residual signal and the encoded impulse signal can be decoded independent of each other, and a useful signal is obtained. Due to the fact that neither the encoded impulse signal, nor the encoded residual signal will be an audio signal with an acceptable audio quality, rendering of only one signal without the other signal does not make any sense in embodiments. Thus, the output interface 22 can operate in a completely bit-efficient manner, without having to worry about the datastream, and whether it can be decoded in a scalable way or not.

In an embodiment, the inventive audio decoder includes a residual signal generator 26. The residual signal generator 26 is adapted for receiving the audio signal 10 and information 28 relating to the extracted impulse signal portions, and for outputting the residual signal 18 which does not include the extracted signal portions. Depending on the implementation, the residual signal generator 26 or the signal encoder 16 may output side information as well. Output and transmission of side information 14, however, is not necessarily necessitated due to the fact that a decoder can be pre-set in a certain configuration and, as long as the encoder operates based on these configurations, the inventive encoder does not need to generate and transmit any additional side information. Should there, however, be a certain flexibility on the encoder side and on the decoder side, or should there be a specific operation of the residual signal generator which is different from a pure subtraction, it might be useful to transmit side information to the decoder so that the decoder and, specifically, the combiner within the decoder, ignores portions of the decoded residual signal which have been introduced on the encoder side only to have a smooth and non-impulse-like residual signal without any holes.

FIG. 2 illustrates a decoder embodiment for decoding an encoded audio signal 24 which is the same signal as is output by the output interface 22. Generally, the encoded audio signal 24 includes an encoded impulse-like signal and an encoded residual signal. The decoder may comprise a decoder input interface 28 for extracting the encoded impulse signal 12, the encoded residual signal 20, and the side information 14 from the encoded audio signal 24. The encoded impulse signal 12 is input into an impulse decoder 30 for decoding the encoded impulse-like signal using a decoding algorithm adapted to a coding algorithm used for generating the encoded impulse-like signal, i.e., coding algorithm as was used in block 10 of FIG. 12. The decoder in FIG. 2 furthermore comprises a signal decoder 32 for decoding the encoded residual signal using a decoding algorithm adapted to a coding algorithm used for generating the encoded residual signal, i.e., a coding algorithm used in block 16 of FIG. 1. The output signals of both decoders 30 and 32 are forwarded to an input into a signal combiner 34 for combining the decoded impulse-like signal and the decoded residual signal to provide a decoded output signal 36. Specifically, the signal decoder 32 and the impulse decoder 30 are operative to provide for selected portions of the decoded audio signal output values relating to the same time instant of the decoded audio signal.

Figure 14:
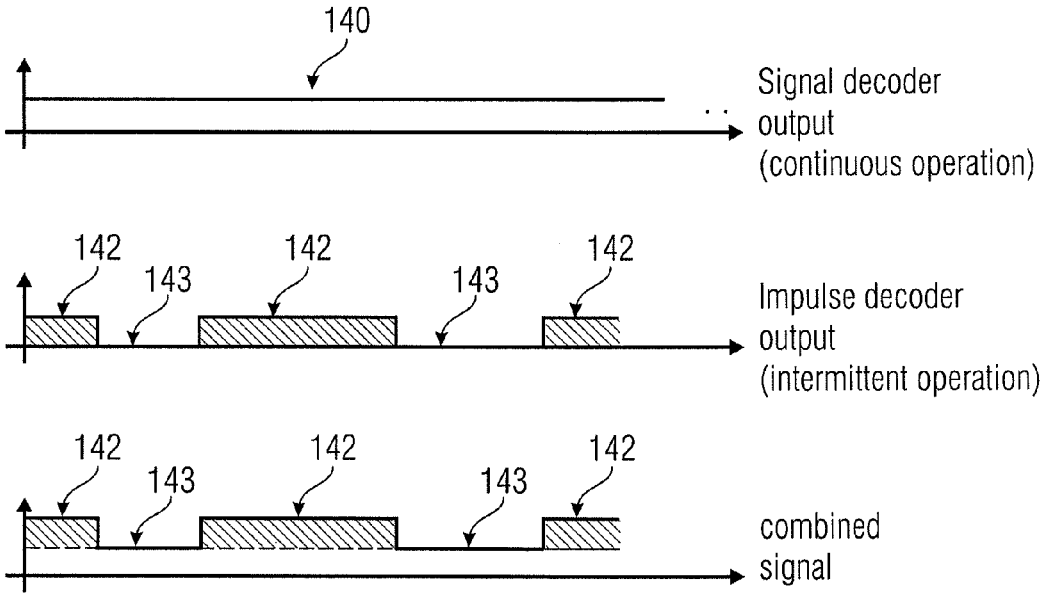
FIG. 14 illustrates the operation modes illustrating the continuous operation of the signal decoder and the intermittent operation of the impulse decoder.

This characteristic will be discussed in connection with FIG. 14. FIG. 14 schematically illustrates an output of the signal decoder 32 at 140. It is illustrated in FIG. 14 that the output 140 of the signal decoder continuously exists. This means that the signal decoder (and the corresponding signal encoder) continuously operates and provides an output signal as long as the audio signal exists. Naturally, only when the audio track is over, the signal decoder will stop its output as well, since there is no input signal to encode anymore.

The second line in FIG. 14 illustrates the impulse decoder output 142. Specifically, it is outlined in FIG. 14 that there are portions 143, in which there does not exist an impulse decoder output due to the fact that the original audio signal did not have any stationary components in these time portions 143. However, in the other time portions, the signal had stationary components and/or impulse-like components, and the impulse-like components are generated by the impulse decoder output. Thus, in the time portions 142, both decoders provide output values which are related to the same time instant of a decoded signal. However, in the time portions 143, the output signal only consists of the residual signal decoder output and does not have any contribution from the impulse decoder.

FIG. 3*a* illustrates an embodiment of an encoder in a so-called open-loop configuration. The impulse extractor 10 includes a general impulse extractor for generating a non-encoded impulse signal indicated on line 40. The impulse extractor is indicated at 10*a*. The impulse signal 40 is forwarded to the impulse coder 10*b* which finally outputs the encoded impulse signal 12. The information on the impulse signal on line 28 corresponds to the non-encoded impulse signal as extracted by the impulse extractor 10*a*. The residual signal generator 26 is implemented in FIG. 3*a* as a subtractor for subtracting the non-encoded impulse signal on line 28 from the audio signal 10 to obtain the residual signal 18.

Advantageously, the signal encoder 16 is implemented as a filterbank based audio encoder, since such a filterbank based audio encoder is specifically useful for encoding a residual signal which does not have any impulse-like portions anymore, or in which the impulse-like portions are at least attenuated with respect to the original audio signal 10. Thus, the signal is put through a first processing stage 10*a* which is designed to provide the input signals of the partial coders at its output. Specifically, the splitting algorithm is operative to generate output signals on line 40 and line 18 which fulfill the earlier discussed condition 1 (the impulse coder receives impulse-like signals) and condition 2 (the residual signal for the residual coder is temporarily smoothed). Thus, as illustrated in FIG. 3*a*, the impulse extraction module 10*a* extracts the impulse signal from the audio input signal 10.

The residual signal 18 is generated by removing the impulse signal from the audio input. This removal can be done by subtraction as is indicated in FIG. 3*a*, but can also be performed by other measures such as replacing the impulse-like region of the audio signal by a less impulse-like ("flattened") signal that can be derived from the original audio signal 10 by appropriate time-variant scaling or interpolation between regions to the left and right of the impulse-like region. In the consecutive parallel coding stages 10*b*, 16, the impulse signal (if present) is coded by a dedicated impulse coder 10*b* and the residual signal may be coded by a filterbank-based audio coder 16.

In a different embodiment, in which a time portion of the audio signal has been detected as impulse-like, a pure cutting out operation of this time portion and encoding the portion only with the impulse coder would result in a hole in the residual signal for the signal coder. In order to avoid this hole, which is a problematic discontinuity for the signal encoder, a signal to be introduced into the "hole" is synthesized. This signal can be, as discussed later, an interpolation signal or a weighted version of the original signal or a noise signal having a certain energy.

In one embodiment, this interpolated/synthesized signal is subtracted from the impulse like "cut-out" signal portion so that only the result of this subtraction operation (the result is an impulse-like signal as well) is forwarded to the impulse coder. This embodiment will make sure that—on the decoder side—the output of the residual coder and the output of the impulse decoder can be combined in order to obtain the decoded signal. In this embodiment, all signals obtained by both output decoders are used and combined to obtain the output signal, and any discarding of an output of any one of both decoders will not take place.

Subsequently, other embodiments of the residual signal generator 26, apart from a subtraction, are discussed.

As stated before, a time-variant scaling of the audio signal can be done. Specifically, as soon as an impulse-like portion of the audio signal is detected, a scaling factor can be used for scaling the time domain samples of the audio signal with a scaling factor value of less than 0.5 or, for example, even less than 0.1. This results in a decrease of the energy of the residual signal at the time period in which the audio signal is impulse-like. However, in contrast to simply setting to 0 the original audio signal in this impulse-like period, the residual signal generator 26 makes sure that the residual signal does not have any "holes", which are again, instationarities which would be quite problematic for the filterbank based audio coder 16. On the other hand, the encoded residual signal during the impulse-like time portion which is the original audio signal multiplied by a small scaling factor might not be used on the decoder-side, or might only to a small degree be used on the decoder-side. This fact may be signaled by a certain additional side information 14. Thus, a side information bit generated by such a residual signal generator might indicate which scaling factor was used for down-scaling the impulse-like portion in the audio signal, or which scaling factor is to be used on the decoder-side to correctly assemble the original audio signal after having decoded the individual portions.

Another way of generating the residual signal is to cut out the impulse-like portion of the original audio signal and to interpolate the cut out portion using the audio signal at the beginning or at the end of the impulse-like portion in order to provide a continuous audio signal, which is however, no longer impulse-like. This interpolation can also be signaled by a specific side information bit 14, which generally provides information regarding the impulse coding or signal coding, or residual signal generation characteristic. On the decoder side, a combiner can fully delete, or at least attenuate to a certain degree, the decoded representation of the interpolated portion. The degree or indication can be signaled via a certain side information 14.

Furthermore, it is of advantage to provide the residual signal so that a fade-in and a fade-out occurs. Thus, the time-variant scaling factor is not abruptly set to a small value, but is continuously reduced until the small value and, at the end or around the end of the impulse-like portion, the small scaling factor is continuously increased to a scaling factor in the regular mode, i.e., to a small scaling factor of 1 for an audio signal portion which does not have an impulse-like characteristic.

FIG. 3*b* illustrates a decoder which corresponds to the encoder in FIG. 3*a*, where the signal decoder 32 of FIG. 2 is implemented as a filterbank based audio decoder, and where the signal combiner 34 is implemented as a sample-wise adder.

Alternatively, the combination performed by the signal combiner 34 can also be performed in the frequency domain or in the subband domain provided that the impulse decoder 30 and the filterbank based audio decoder 32 provide output signals in the frequency domain or in the subband domain.

Furthermore, the combiner 34 does not necessarily have to perform a sample-wise addition, but the combiner can also be controlled by side information such as the side information 14 as discussed in connection with FIGS. 1, 2 and 3*a*, in order to apply a time variant scaling operation in order to compensate for encoder-side fade in and fade out operations, and in order to handle signal portions which have been generated on the encoder-side to flatten the residual signals, such as by insertion, interpolation, or time-variant scaling. When, the residual signal generator 26 is operative to perform a sample-wise subtraction as indicated in FIG. 3*a*, then the decoder-side combiner 34 will not require any additional side information and will perform a sample-wise addition without any additional processing steps such as fade, fade out, or signal scaling.

For voiced speech signals, the excitation signal, i.e., the glottal impulses are filtered by the human vocal tracts which can be inverted by an LPC filter. Thus, the corresponding impulse extraction for glottal impulses typically may include an LPC analysis before the actual impulse picking stage and an LPC synthesis before calculating the residual signal as is illustrated in FIG. 4*a*, which is additionally, an open-loop implementation.

Figure 9A:
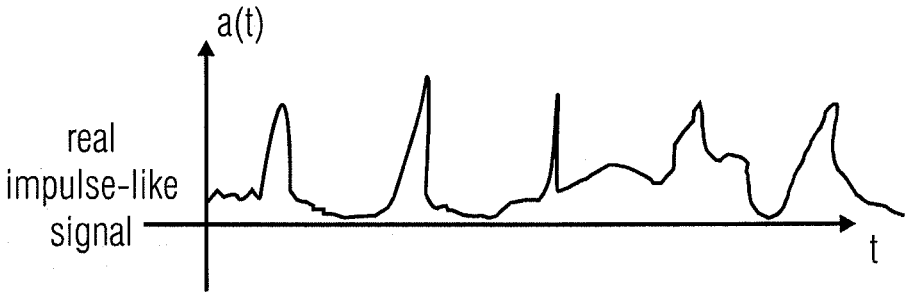
FIG. 9*a* illustrates a wave form of a real impulse-like signal.

Specifically, the audio signal 8 is input into an LPC analysis block 10*a*. The LPC analysis block produces a real impulse-like signal as is, for example, illustrated in FIG. 9*a*. This signal is input into an impulse picking stage 10*c*, which processes the real impulse-like signal, as for example illustrated in FIG. 9*a*, in order to output an impulse signal which is an ideal or at least a more ideal impulse-like signal compared to the real impulse-like signal at the input into the impulse picking stage 10*c*. This impulse signal is subsequently input into the impulse coder 10*b*. The impulse coder 10*b* provides a high quality representation of the input impulse-like signal, due to the fact that this coder is specifically suited for such impulse-like signals and due to the fact that the input impulse signal on line 48 is an ideal, or almost ideal, impulse signal. In the FIG. 4*a* embodiment, the impulse signal on line 48, which corresponds to the "information on impulse signal" 28 of FIG. 1, is input into an LPC synthesis clock 26*b* in order to "transform" the ideal impulse-like signal which exists in the "LPC domain" back into the time domain. Thus, the output of the LPC synthesis block 26*b* is then input into the subtractor 26*a*, so that a residual signal 18 is generated, which is the original audio signal, but which no longer includes the pulse structure represented by the ideal impulse signal on line 48 or 28. Thus, the residual signal generator 26 of FIG. 1 is implemented in FIG. 4*a* as the LPC synthesis block 26*b* and the subtractor 26*a*.

The functionality of the LPC analysis 10*a* and the LPC synthesis 26*b* will subsequently be discussed in more detail with respect to FIGS. 7*a* to 7*e*, FIG. 8, and FIGS. 9*a* to 9*b*.

Figure 7A:
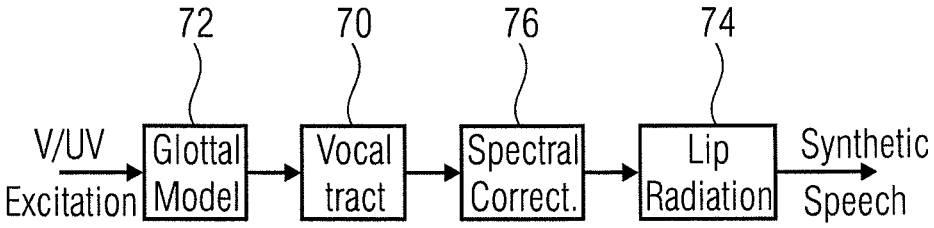
FIGS. 7*a* to 7*d* illustrate voiced/unvoiced excitation signals as an example for impulse-like and stationary signals.
Figure 7B:
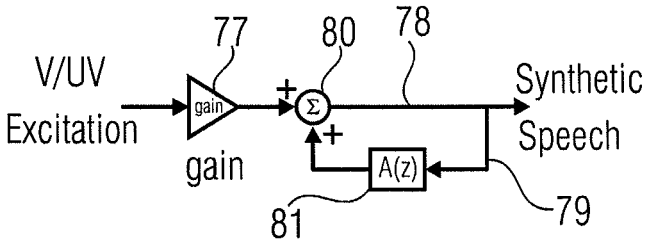

FIG. 7*a* illustrates a model of a linear speech production system. This system assumes a two-stage excitation, i.e., an impulse-train for voiced speech as indicated in FIG. 7*a*, and a random-noise for unvoiced speech as indicated in FIG. 7*d*. The vocal tract is modeled as an all-pole transform filter 70 which processes pulses of FIG. 7*c* or FIG. 7*d*, generated by the glottal model 72. The all-pole transfer function is formed by a cascade of a small number of two-pole resonators representing the formants. The glottal model is represented as a two-pole low-pass filter, and the lip-radiation model 74 is represented by $L(z)=1-z^{1}$. Finally, a spectral correction factor 76 is included to compensate for the low-frequency effects of the higher poles. In individual speech representations the spectral correction is omitted and the 0 of the lip-radiation function is essentially cancelled by one of the glottal poles. Hence, the system of FIG. 7*a* can be reduced to an all pole-model of FIG. 7*b* having a gain stage 77, a forward path 78, a feedback path 79, and an adding stage 80. In the feedback path 79, there is a prediction filter 81, and the whole source-system synthesis model illustrated in FIG. 7*b* can be represented using z-domain functions as follows:

$$S(z)=g/(1-A(z))\cdot X(z),$$

where g represents the gain, A(z) is the prediction filter as determined by an LPC analysis, X(z) is the excitation signal, and S(z) is the synthesis speech output.

Figure 7C:
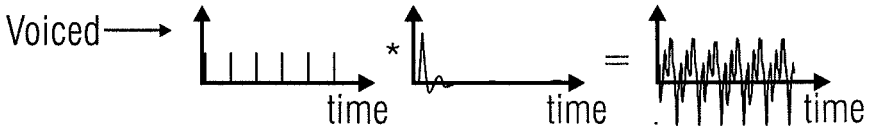
Figure 7D:
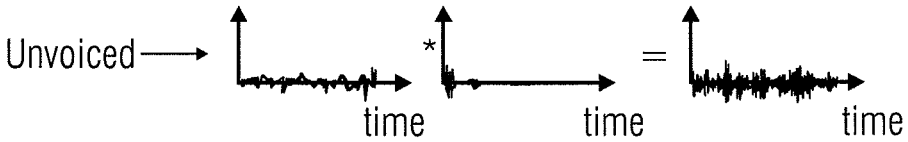

FIGS. 7*c* and 7*d* give a graphical time domain description of voiced and unvoiced speech synthesis using the linear source system model. This system and the excitation parameters in the above equation are unknown and may be determined from a finite set of speech samples. The coefficients of A(z) are obtained using linear prediction. In a p-th order forward linear predictor, the present sample of the speech sequence is predicted from a linear combination of t passed samples. The predictor coefficients can be determined by well-known algorithms such as the Levinson-Durbin algorithm, or generally an autocorrelation method or a reflection method.

Figure 7E:
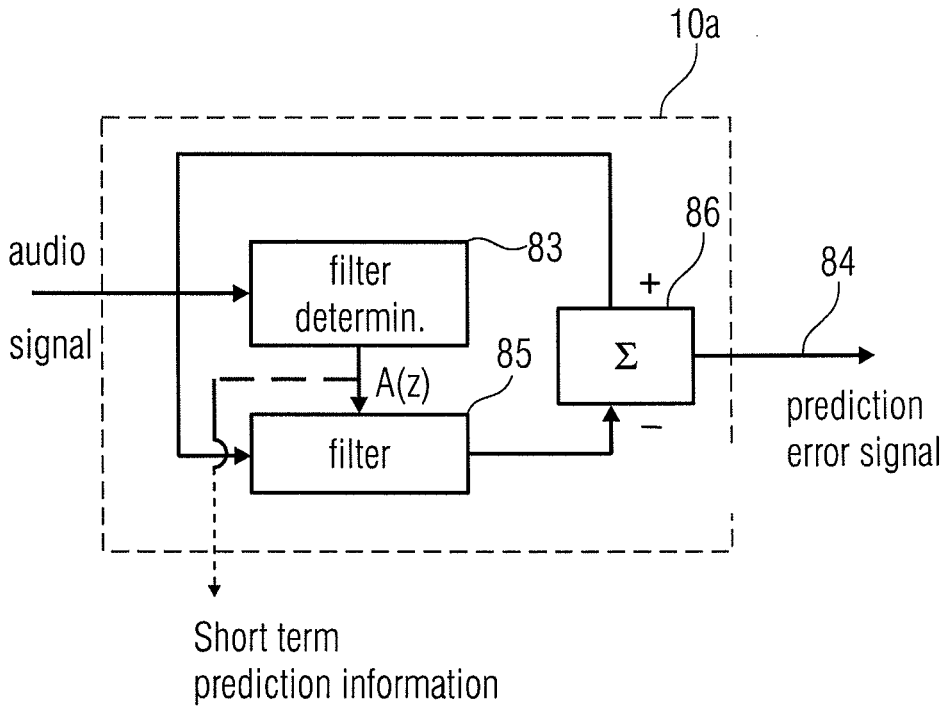
FIG. 7*e* illustrates an encoder-side LPC stage providing short-term prediction information and the prediction error signal.

FIG. 7*e* illustrates a more detailed implementation of the LPC analysis block 10*a* of FIG. 4*a*. The audio signal is input into a filter determination block which determines the filter information A(z). This information is output as the short-term prediction information required for a decoder. In the FIG. 4*a* embodiment, i.e., the short-term prediction information might be required for the impulse coder output signal. When, however, only the prediction error signal at line 84 is necessitated, the short-term prediction information does not have to be output. Nevertheless, the short-term prediction information is necessitated by the actual prediction filter 85. In a subtractor 86, a current sample of the audio signal is input and a predicted value for the current sample is subtracted so that for this sample, the prediction error signal is generated at line 84. A sequence of such prediction error signal samples is very schematically illustrated in FIG. 9*a*, where, for clarity issues, any issues regarding AC/DC components, etc. have not been illustrated. Therefore, FIG. 9*a* can be considered as a kind of a rectified impulse-like signal.

Figure 8:
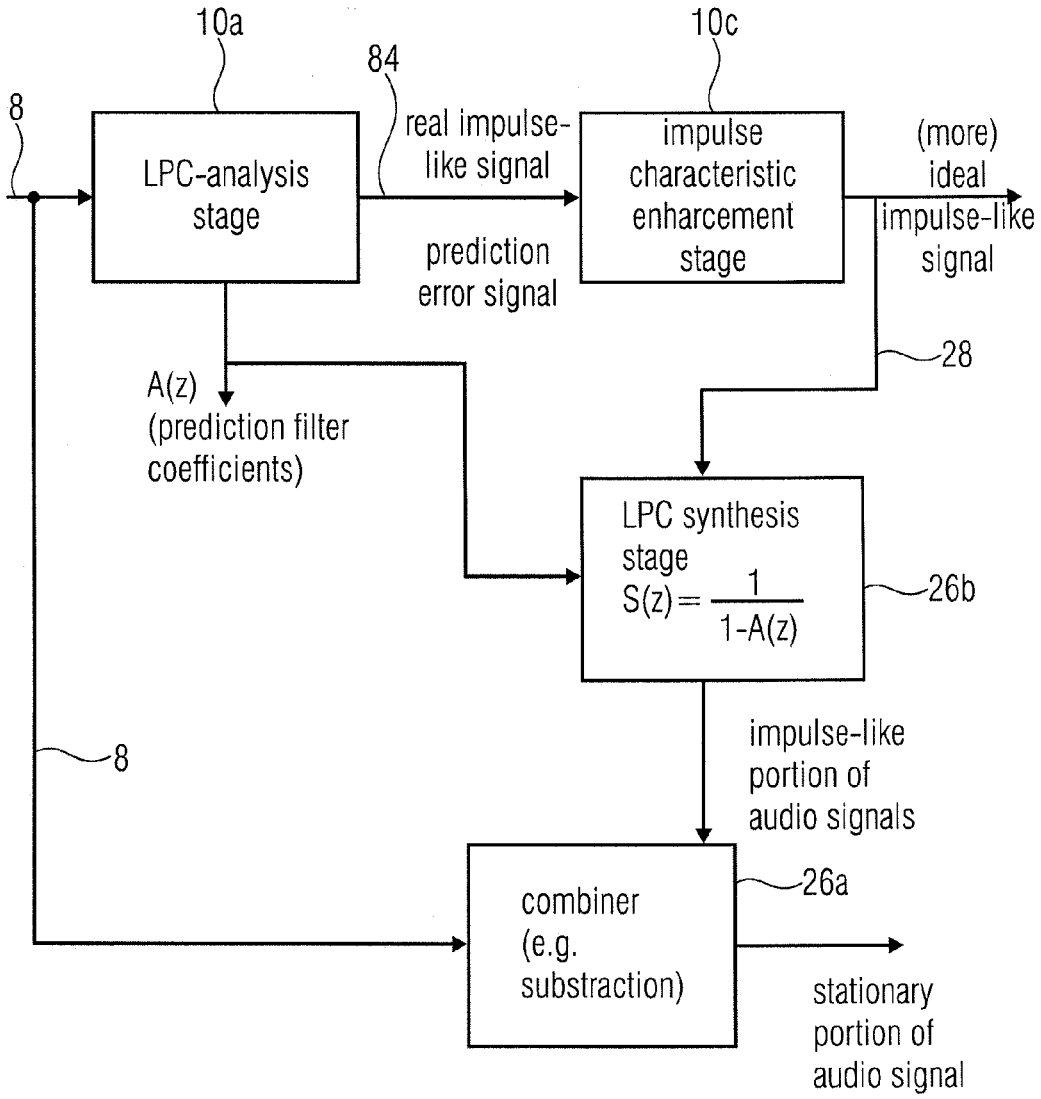
FIG. 8 illustrates an embodiment of the FIG. 4*a* open-loop embodiment.
Figure 9B:
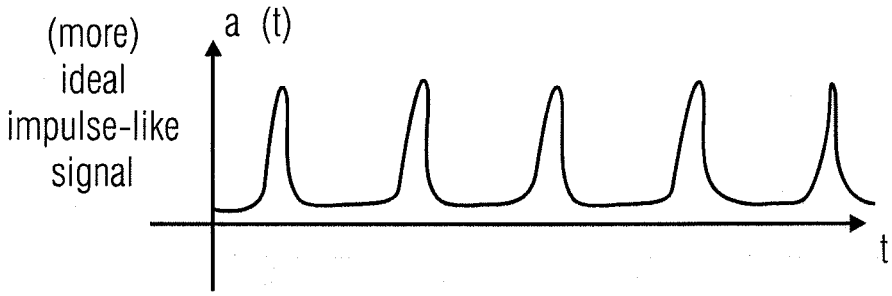
FIG. 9*b* illustrates an enhanced or more ideal impulse-like signal as generated by the impulse characteristic enhancement stage of FIG. 8.

FIG. 8 will subsequently be discussed in more detail. FIG. 8 is similar to FIG. 4*a*, but shows block 10*a* and block 26*b* in more detail. Furthermore, a general functionality of the impulse characteristic enhancement stage 10*c* is discussed. The LPC analysis stage 10*a* in FIG. 8 can be implemented as shown in detail in FIG. 7*e*, where the short-term prediction information A(z) is input into the synthesis stage 26*b*, and the prediction error signal which is the "real impulse-like signal" is output here at line 84. When it is assumed that the signal is mixed, i.e., includes speech components and other components, then the real impulse-like signal might be considered as a superposition of the excitation signals in FIGS. 7*c* and 7*d*, which in a rectified representation, correspond to FIG. 9*a*. One can see a real impulse-like signal which, additionally, has stationary components. These stationary components are removed by the impulse characteristic enhancement stage 10*c*, which provides at its output, a signal which is for example similar to FIG. 9*b*. Alternatively, the signal output by block 10*c* can be the result of a pure peak picking which means that an impulse, starting from some samples to the left of the peak and ending at some samples to the right of the peak, is picked out from the signal in FIG. 9*a*, where signal samples of the signal in FIG. 9*a* between the peaks are completely discarded. This would mean that a similar signal as the one shown in FIG. 7*c* is generated by block 10*c*, with the difference that the impulses are not ideal DIRAC pulses, but have a certain impulse width. Furthermore, the impulse characteristic enhancement stage 10*c* can be operative to process the peaks so that each peak has the same height and shape which is schematically illustrated in FIG. 9*b*.

The signal generated by block 10*c* will be ideally suited for the impulse coder 10*b* and the impulse coder will provide an encoded representation necessitating a small number of bits and being a representation of the ideal impulse-like signal without, or only with a very small amount of quantization errors.

The LPC synthesis stage 26*b* in FIG. 8 can be implemented in exactly the same manner as the all-pole model in FIG. 7*b*, with a unity gain or a gain different from 1, so that the transfer function as indicated in block 26*b* is implemented in order to have a representation of the ideal pulse-like signal at the output of block 10*c* in the time domain, so that a sample-wise combination such as a subtraction can be performed in block 26*a*. Then, the output of block 26*a* will be the residual signal, which in an ideal case, only includes the stationary portion of the audio signal and no longer includes the impulse-like portion of the audio signal. Any information loss introduced by performing the impulse characteristic enhancement operation in block 10*c* such as peak picking is non-problematic, since this "error" is accounted for in the residual signal and is not lost. Importantly, however, the positions of the impulses picked by stage 10*c* precisely represent the impulse positions in the audio signal 8 so that the combination of both signals in block 26*a*, especially when made using a subtraction, does not result in two pulses which are closely adjacent to each other, but results in a signal without any pulses, since a pulse in the original audio signal 8 has been cancelled due to the combination operation by block 26*a*.

This feature is an advantage of the so-called "open-loop embodiment" and might be a disadvantage of the so-called "closed-loop embodiment" which is illustrated in FIG. 4*b*. FIG. 4*b* is different from FIG. 4*a* in that the impulse coder output signal is input into an impulse decoder 26*e*, which is a part of the residual signal generator 26 of FIG. 1. When the impulse coder 10*b* introduces quantization errors into the positions of the pulses, and when these errors are not compensated by the operation of the impulse decoder 26*c*, then the subtraction operation in block 26*a* will result in a residual signal which not only has the original pulses in the audio signal, but has, in the neighborhood to these pulses, additional pulses which have been introduced due to the subtraction operation. In order to avoid this situation, the combiner 26 can be operative to not just perform a sample-wise subtraction, but to perform an analysis of the impulse decoder 26*c* output signal, so that a synchronized subtraction is obtained.

The "closed-loop" operation can also be considered as a cascaded splitting operation. One of the two partial coders (advantageously the impulse coder) is tuned to accept an appropriate part of the input signal (advantageously the glottal impulses). Then, the other partial coder 16 is fed by the residual signal consisting of the difference signal between the original signal and the decoded signal from of the first partial coder. The impulse signal is first coded and decoded, and the quantized output is subtracted from the audio input in order to generate the residual signal in the closed-loop approach, which is coded by the filterbank-based audio coder.

As an example, a CELP or an ACELP coder can be used as an efficient impulse coder as illustrated in FIG. 4*c*, which will be discussed later. Advantageously, however, the CELP or ACELP routine is modified such that the coder only models impulsive parts of the input signal, rather than trying to also model tonal or very stationary signal components. In other words, once a certain number of impulses are spent to model impulsive signal parts, the allocation of more impulses to model the other parts of the signal would be counterproductive and would deteriorate the quality of the overall output signal. Thus, an appropriate preprocessor or controller, as for example illustrated at 1000 in FIG. 10, terminates the impulse allocation procedure once all actually occurring impulses are modeled.

Furthermore, it is of advantage that the residual after removal from the impulse coder output signal is constructed such that it becomes rather flat over time in order to fulfill condition number 2, in order to be suitable for coding with the filterbank-based coder 16 of FIG. 4*c*.

Thus, FIG. 4*c* illustrates this approach, in which the modified ACELP coder 10 operates both, as the impulse extractor and impulse coder. Again, the residual signal generator 26 of FIG. 1 uses a subtraction 26*a* to remove the impulse-like portions from the audio signal, but also other methods can be applied such as flattening or interpolation, as previously described.

The disadvantage of the open-loop implementation of FIG. 4*b*, in which the signal is first separated into an impulse signal and a residual signal, with both signal portions then being coded individually, and which involves lossy coding, i.e. quantization in both the impulse coder and the filterbank-based audio coder, is that the quantization errors of both coders have to be controlled and perceptually minimized individually. This is due to the fact that at the decoder output, both quantization errors add up.

However, the advantage of the open-loop implementation is that the impulse extraction stage produces a clean impulse signal, which is not distorted by quantization errors. Thus the quantization in the impulse coder does not affect the residual signal.

Both implementations can, however, be mixed in order to implement a kind of mixed mode. Thus, components from both the open-loop and the closed-loop approaches are implemented together.

An efficient impulse coder usually quantizes both the individual values and the positions of the impulses. One option for a mixed open/closed-loop mode is to use the quantized impulse values and the accurate/unquantized impulse positions for calculating the residual signal. The impulse position is then quantized in an open-loop fashion. Alternatively, an iterative CELP analysis-by-synthesis process for the detection of impulse-like signals can be used, but a dedicated coding tool for the actual coding the impulse signal is implemented, which quantizes or not, the position of the pulses with a small quantization error.

Figure 6:
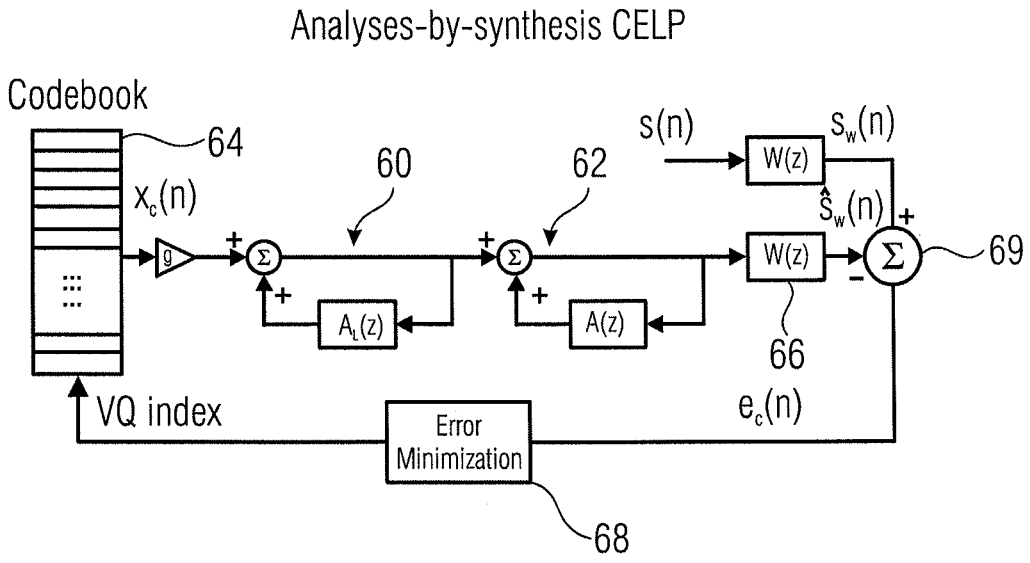
FIG. 6 illustrates a block diagram of an analysis by synthesis CELP encoder.

Subsequently, an analysis-by-synthesis CELP encoder will be discussed in connection with FIG. 6 in order to illustrate the modifications applied to this algorithm, as illustrated in FIGS. 10 to 13. This CELP encoder is discussed in detail in "Speech Coding: A Tutorial Review", Andreas Spanias, Proceedings of the IEEE, Vol. 82, No. 10, October 1994, pages 1541-1582. The CELP encoder as illustrated in FIG. 6 includes a long-term prediction component 60 and a short-term prediction component 62. Furthermore, a codebook is used which is indicated at 64. A perceptual weighting filter W(z) is implemented at 66, and an error minimization controller is provided at 68. s(n) is the excitation signal as, for example, generated by the LPC analysis stage 10*a*. This signal is also called "prediction error signal" as indicated at line 84 in FIG. 7*e*. After having been perceptually weighted, the weighted prediction error signal is input into a subtractor 69, which calculates the error between the synthesis signal at the output of block 66 and the actual weighted prediction error signal s(w)(n). Generally, the short-term prediction A(z) is calculated by a LPC analysis stage as indicated in FIG. 7*e*, and depending on this information, the long-term prediction information $A_L(z)$ including the long-term prediction gain g and the vector quantization index, i.e., codebook references are calculated. The CELP algorithm encodes the excitation using a codebook of for example Gaussian sequences. The ACELP algorithm, where the "A" stands for "Algebraic" has a specific algebraically designed codebook.

A codebook may contain more or less vectors where each vector is some samples long. A gain factor g scales the excitation vector and the excitation samples are filtered by the long-term synthesis filter and the short-term synthesis filter. The "optimum" vector is selected such that the perceptually weighted mean square error is minimized. The search process in CELP is evident from the analysis-by-synthesis scheme illustrated in FIG. 6.

Subsequently, an exemplary ACELP algorithm is described in connection with FIG. 10, which additionally illustrates the modification performed in accordance with an embodiment of the present invention discussed in connection with FIG. 4*c*.

The publication "A simulation tool for introducing Algebraic CELP (ACELP) coding concepts in a DSP course", Frontiers in Education Conference, Boston, Mass., 2002, Venkatraman Atti and Andreas Spanias, illustrates a description of an educational tool for introducing code excited linear prediction (CELP) coding concepts in University courses. The underlying ACELP algorithm includes several stages, which include a pre-processing and LPC analysis stage 1000, an open-loop pitch analysis stage 1002, a closed-loop pitch analysis stage 1004, and an algebraic (fixed) codebook search stage 1006.

In the pre-processing and LPC analysis stage, the input signal is high-pass filtered and scaled. A second order pole-zero filter with a cut-off frequency of 140 Hz is used to perform the high-pass filtering. In order to reduce the probability of overflows in a fixed-point implementation, a scaling operation is performed. Then, the preprocessed signal is windowed using a 30 ms (240 samples) asymmetric window. A certain overlap is implemented as well. Then, using the Levinson-Durbin algorithm, the linear prediction coefficients are computed from the autocorrelation coefficients corresponding to the windowed speech. The LP coefficients are converted to line spectral pairs which are later quantized and transmitted. The Levinson-Durbin algorithm additionally outputs reflection coefficients which are used in the open-loop pitch analysis block for calculating an open-loop pitch $T_{op}$ by searching the maximum of an autocorrelation of a weighted speech signal, and by reading out the delay at this maximum. Based on this open-loop pitch, the closed-loop pitch search stage 1004 is searching a small range of samples around $T_{op}$ to finally output a highly accurate pitch delay and a long-term prediction gain. This long-term prediction gain is additionally used in the algebraic fixed codebook search and finally output together with other parametric information as quantized gain values. The algebraic codebook consists of a set of interleaved permutation codes containing few non-zero elements which have a specific codebook structure in which the pulse position, the pulse number, an interleaving depth, and the number of bits describing pulse positions are referenced. A search codebook vector is determined by placing a selected amount of unit pulses at found locations where a multiplication with their signs is performed as well. Based on the codebook vector, a certain optimization operation is performed which selects, among all available code vectors, the best-fitting code vector. Then, the pulse positions and the times of the pulses obtained in the best-fitting code vector are encoded and transmitted together with the quantized gain values as parametric coding information.

The data rate of the ACELP output signal depends on the number of allocated pulses. For a small number of pulses, such as a single pulse, a small bitrate is obtained. For a higher number of pulses, the bitrate increases from 7.4 kb/s to a resulting bitrate of 8.6 kb/s for five pulses, until a bitrate of 12.6 kb/s for ten pulses.

In accordance with an embodiment of the present as discussed in FIG. 4*c*, the modified ACELP coder 10 includes a pulse number control stage 1000. Specifically, the pulse number control stage measures the LTP gain as output by the closed-loop pitch analysis and performs a pulse number control, if the LTP gain is low. A low LTP gain indicates that the actually processed signal is not very much impulse-train like, and a high LTP gain indicates that the actual signal is impulse-train like, and therefore, very suitable for the ACELP encoder.

Figure 10:
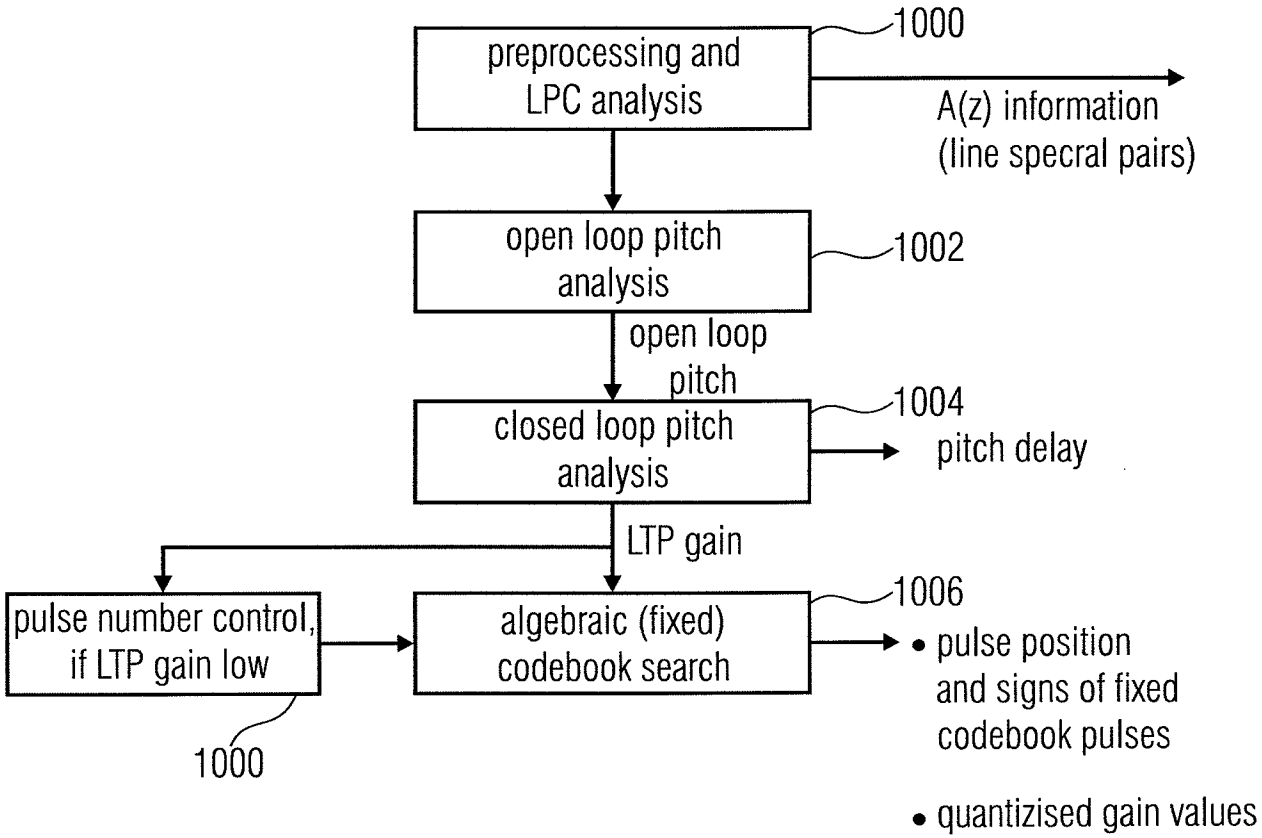
FIG. 10 illustrates a modified CELP algorithm implementable in the FIG. 4*c* embodiment.
Figure 11:
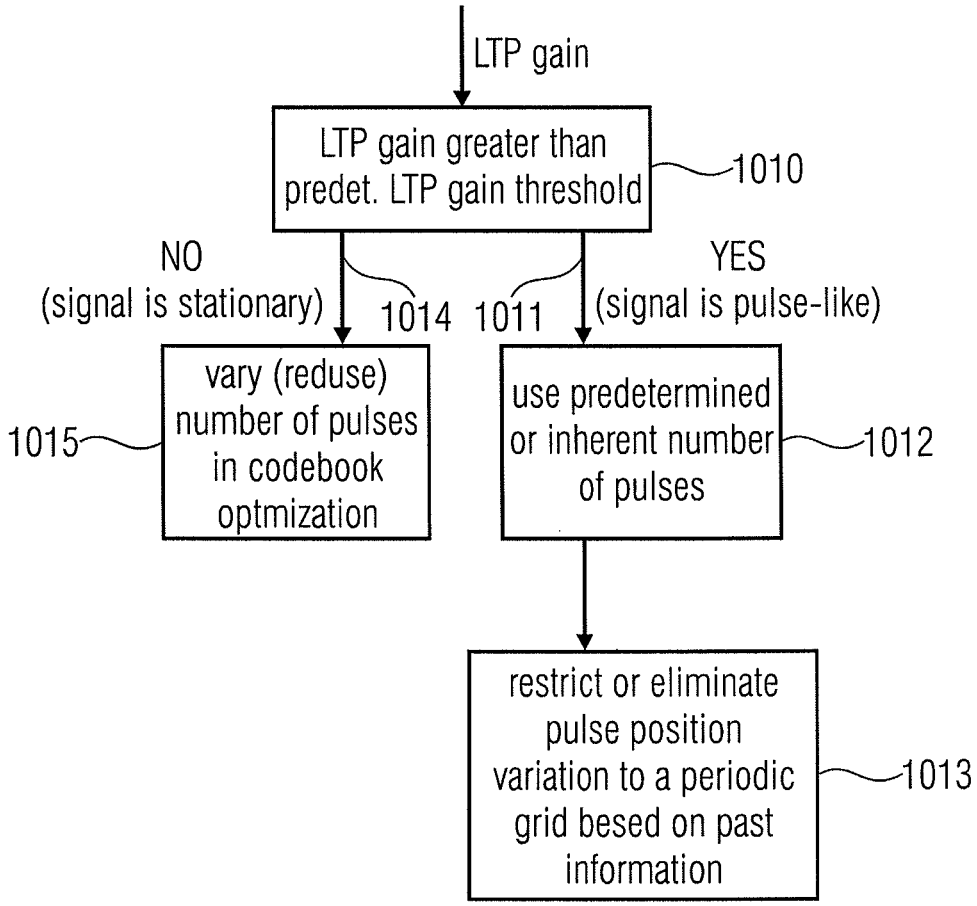
FIG. 11 illustrates a more specific implementation of the algorithm of FIG. 10.

FIG. 11 illustrates an implementation of a block 1000 of FIG. 10. Specifically, a block 1010 determines, whether the LTP gain is greater than a predetermined LTP gain threshold. When this is the case, it is determined that the signal is pulse-like at 1011. Then, a predetermined or inherent number of pulses is used as indicated at 1012. Thus, a straightforward pulse setting or a straightforward pulse number control of an ACELP encoding algorithm is applied without any modification, but a pulse position variation introduced by this encoder is partly or completely restricted, to a periodic grid based on past information in order to make sure that the disadvantage of the closed-loop embodiment is eliminated, as indicated at block 1013. Specifically, if the long-term predictor (LTP) gain is high, i.e., the signal is periodic and pulses were placed in the past frames, i.e., the signal is impulse-like, the algebraic codebook is used to refine the impulse shapes by restricting possible pulse positions to a periodic grid determined by past pulse positions and the LTP lag. Specifically, the number of pulses placed by the algebraic codebook may be constant for this mode, as indicated at block 1011.

If it is determined that the long-term predictor (LTP) gain is low, as indicated at 1014, the number of pulses is varied in the codebook optimization, as indicated at 1015. Specifically, the algebraic codebook is controlled such that it is allowed to place pulses in such a manner that the energy of the remaining residual is minimized and the pulse positions form a periodic pulse train with the period equal to the LTP lag. The process, however is stopped when the energy difference is below a certain threshold, which results in a variable number of pulses in the algebraic codebook.

Figure 12:
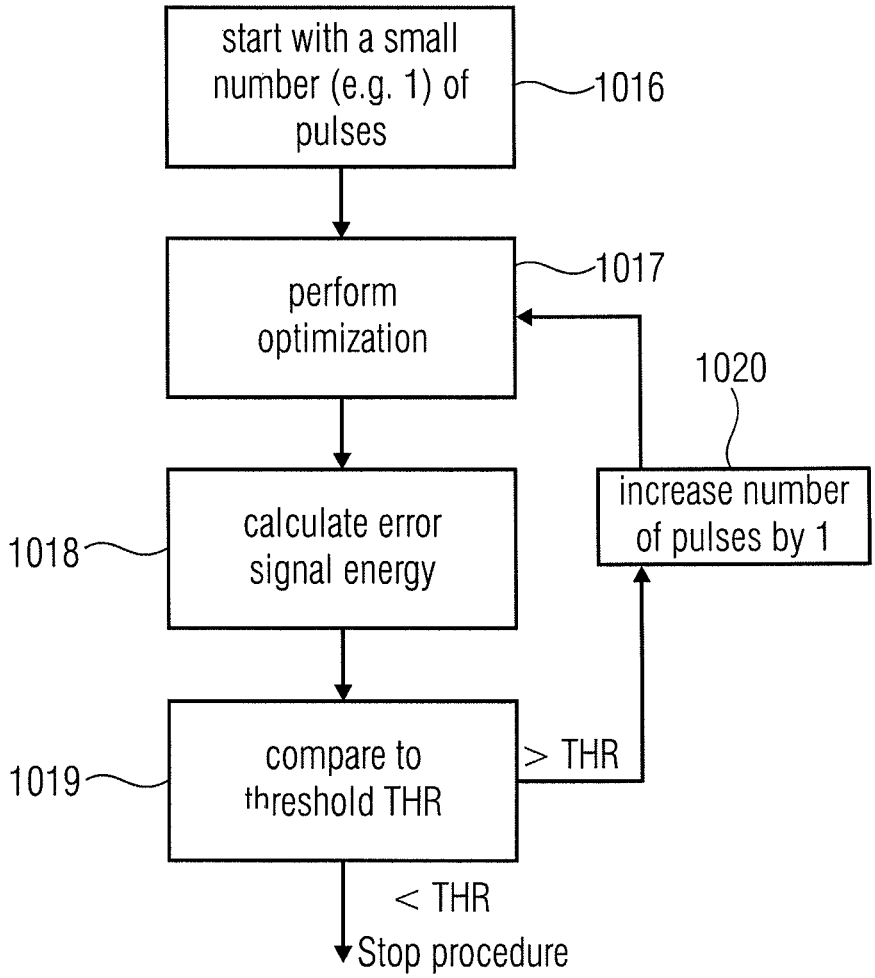
FIG. 12 illustrates a specific implementation of the algorithm of FIG. 11.

Subsequently, FIG. 12 is discussed in order to provide an embodiment of the variation of the number of pulses described in connection with block 1015. At the beginning, the optimization is performed using a small number of pulses, such as a single pulse, as indicated at 1016. Then, the optimization is performed with this small number of pulses, as indicated at 1017. For the best matching code vector, the error signal energy is calculated in block 1018 and is compared to an error energy threshold (THR) in block 1019. the threshold is predetermined and may be suitably set to a value which makes sure that the ACELP encoder only encodes the pulse portion of the signal with a certain accuracy, but does not try to encode non-pulse-like portions of the signal as well, which the coder would do when the inventive controller 1000 of FIG. 10 were not there.

When step 1019 determines that the threshold is met, the procedure is stopped. When, however, the comparison in block 1019 determines that the error signal energy threshold is not yet met, the number of pulses is increased, for example by 1, as indicated at 1020. Then, steps 1017, 1018, and 1019 are repeated, but now with a higher number of pulses. This procedure is continued until a final criterion such as a maximum number of allowed pulses is met. Normally, however, the procedure will stop due to the threshold criterion, so that generally the number of pulses for a non-pulse-like-signal will be smaller than the number of pulses which the encoding algorithm would allocate in the case of a pulse-like signal.

Figure 13:
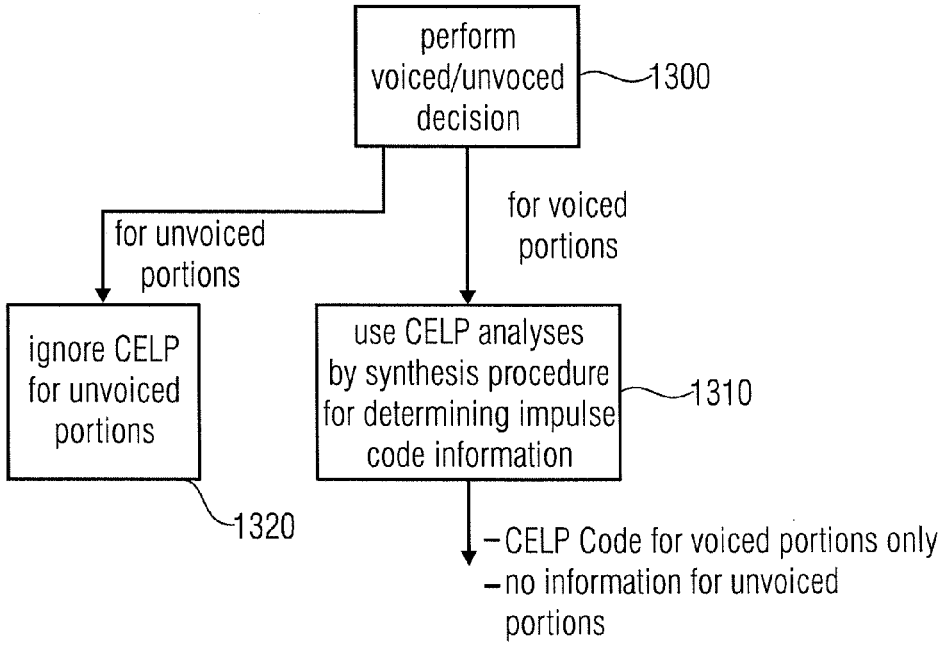
FIG. 13 illustrates another modified CELP algorithm implemented in FIG. 4*c;*

Another modification of an ACELP encoder is illustrated in FIG. 13. In such an encoder, a voiced/unvoiced decision is performed as indicated at 1300. Such an encoder then uses depending on this voice/unvoiced decision, a first codebook for voiced portions, and a second codebook for unvoiced portions. In accordance with an embodiment of the present invention, the CELP analysis-by-synthesis procedure is only used for determining impulse code information when a voiced portion has been detected by block 1300 as is indicated at 1310. When, however, the CELP encoder determines an unvoiced portion, then the CELP encoder output for these unvoiced portions is not calculated or at least ignored and not included into the encoded impulse signal. In accordance with the present invention, these unvoiced portions are encoded using the residual coder and, therefore, the modification of such an encoder consists of ignoring the encoder output for unvoiced portions as indicated at 1320.

Figure 17A:
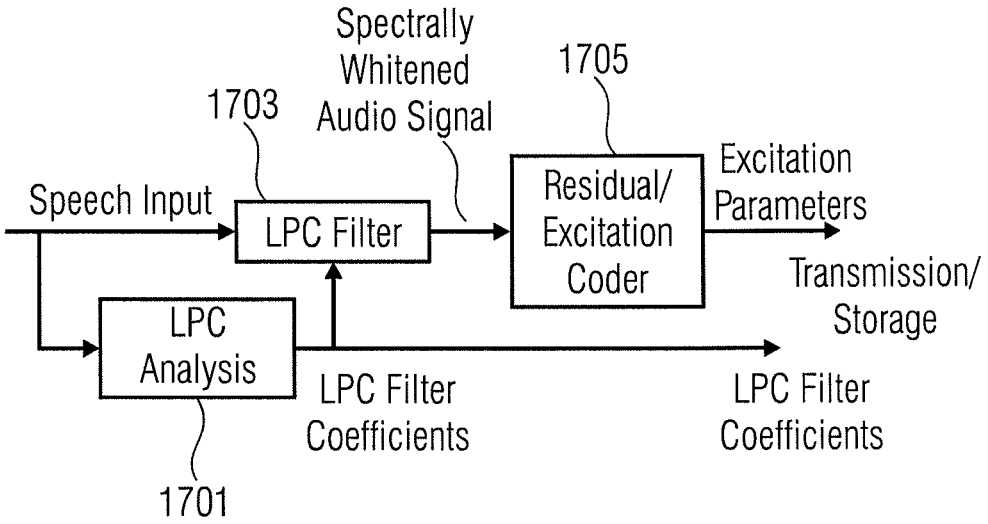
FIG 17A (Prior Art)
FIG. 17*a* illustrates an LPC encoder.
Figure 17B:
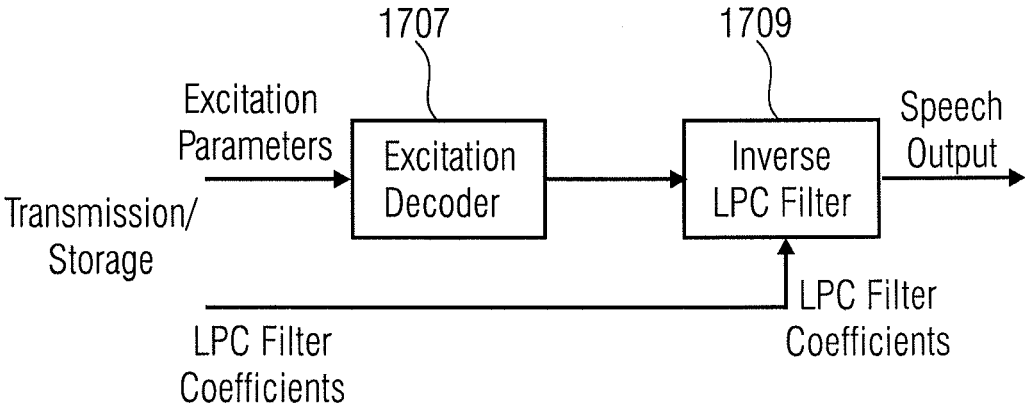
FIG 17B (Prior Art)
FIG. 17*b* illustrates and LPC decoder.
Figure 17C:
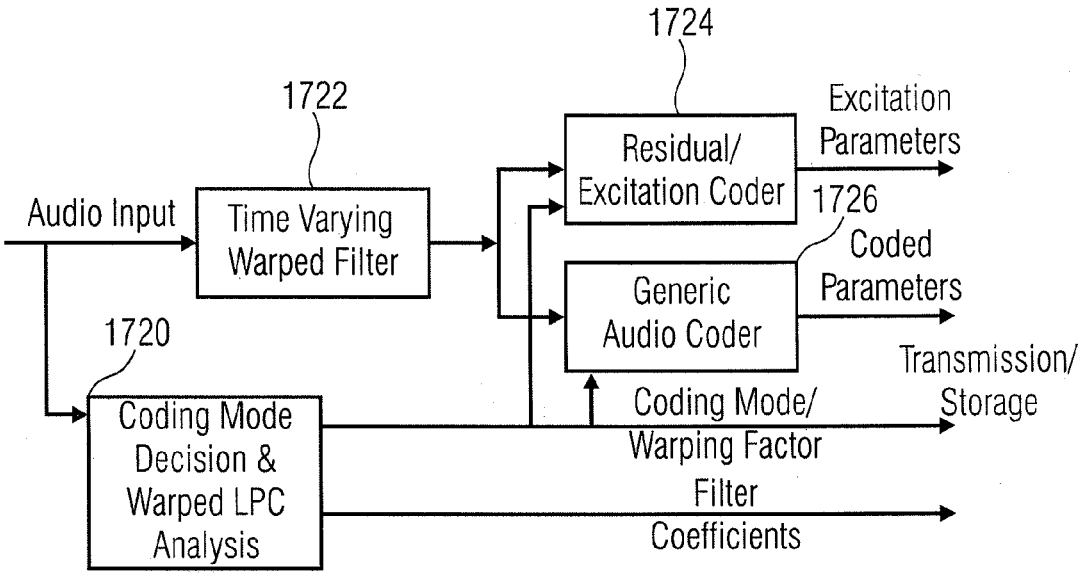
FIG. 17*c* illustrates a coder implementing switched coding with a dynamically variable warped LPC filter.
Figure 18:
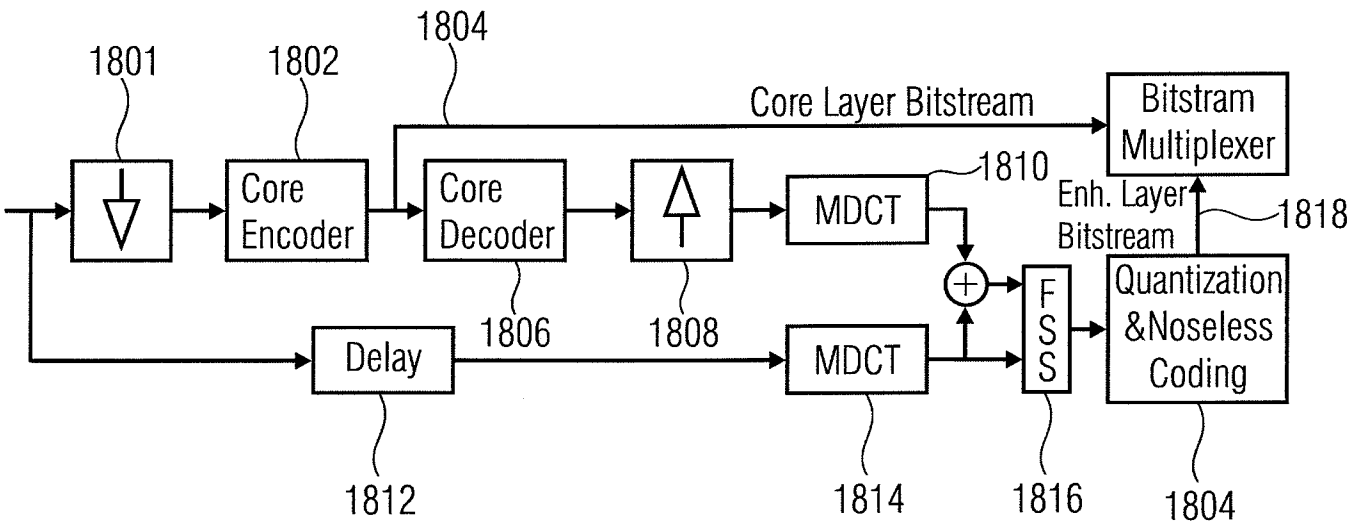
FIG 18 (Prior Art)
FIG. 18 illustrates an MEPG-4 scalable encoder.
Figure 19:
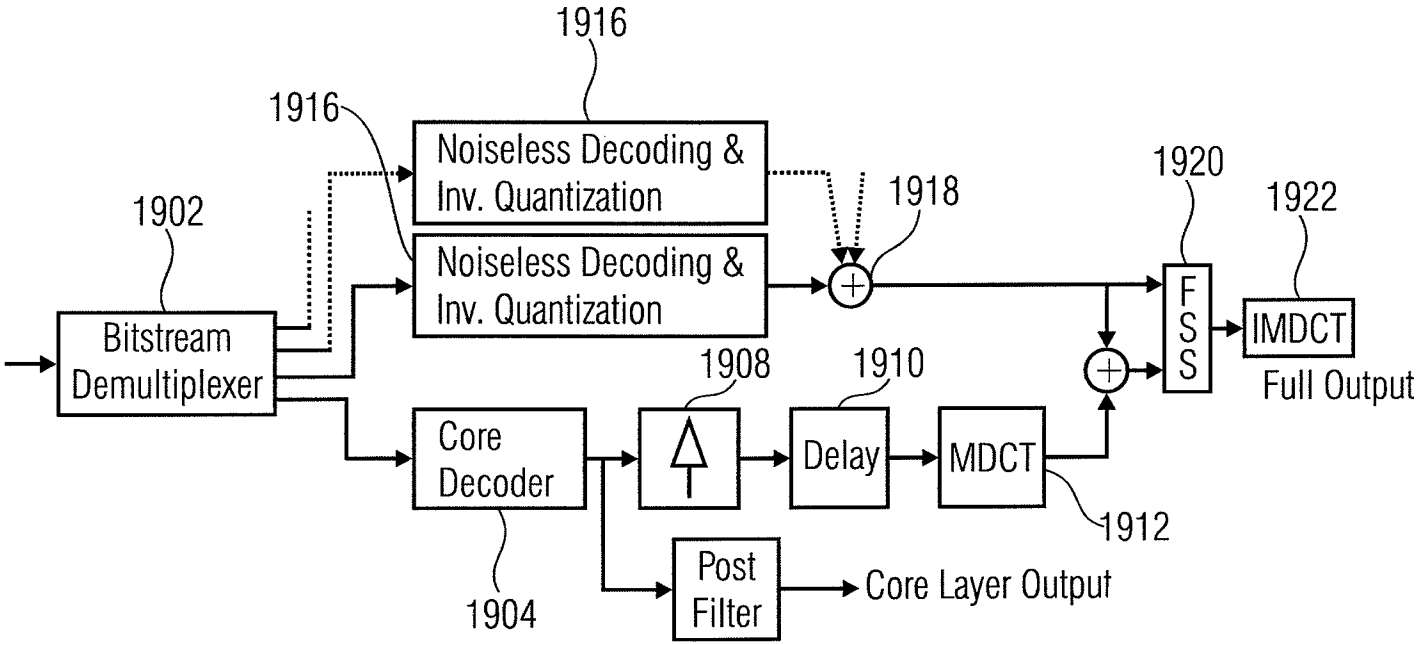
FIG 19 (Prior Art)
FIG. 19 illustrates an MPEG-4 scalable decoder.
Figure 20:
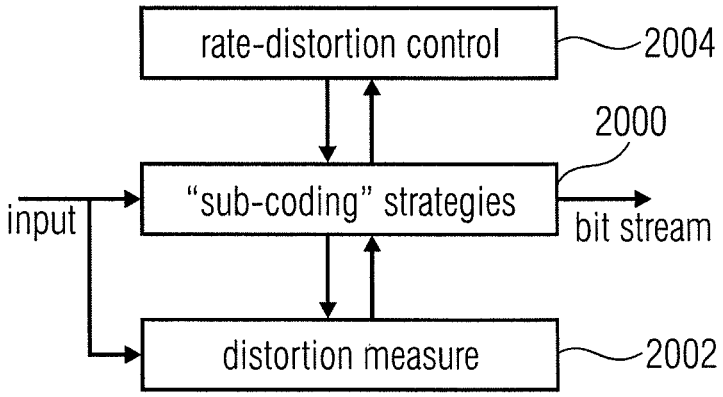
FIG 20 (Prior Art)
FIG. 20 illustrates a schematic diagram of an ARDOR encoder.

The present invention may be combined to the concept of switched coding with a dynamically variable warped LPC filter, as indicated in FIG. 17. The impulse coder employs an LPC filter, where the impulse coder is represented by block 1724. If the filterbank-based residual coder contains a pre/post-filtering structure, it is possible to use a unified time-frequency representation for both the pulse coder 1724 and the residual coder, which is not indicated in FIG. 17*c*, since a processing of the audio input apart from applying the pre-filter 1722 is not performed, but would be performed in order to provide the input into the generic audio coder 1726 which would correspond to the residual signal coder 16 of FIG. 1. In this way one can avoid two analysis filters at the encoder-side and two synthesis filters at the decoder-side. This may include a dynamic adaptation of a generalized filter in its warping characteristics, as has been described with respect to FIG. 17*c*. Thus, the present invention can be implemented into the framework of FIG. 17*c* by processing the pre-filter 1722 output signal before inputting this signal into the generic audio coder 1726, and by additionally extracting the pulses from the audio signal before the audio signal is input into a residual excitation coder 1724. Thus, blocks 10*c*, 26*b*, and 26*a* would have to be placed at the output of the time-varying warped filter 1722 and the input into the residual/excitation coder 1724 which would correspond to the impulse coder 10*b* in FIG. 4*a* and the input of the generic audio coder 1726 which would correspond to the filterbank-based audio coder 16 in FIG. 4*a*. Naturally, the closed-loop embodiment of FIG. 4*b* can additionally be implemented into the FIG. 17*c* encoding system.

Figure 15:
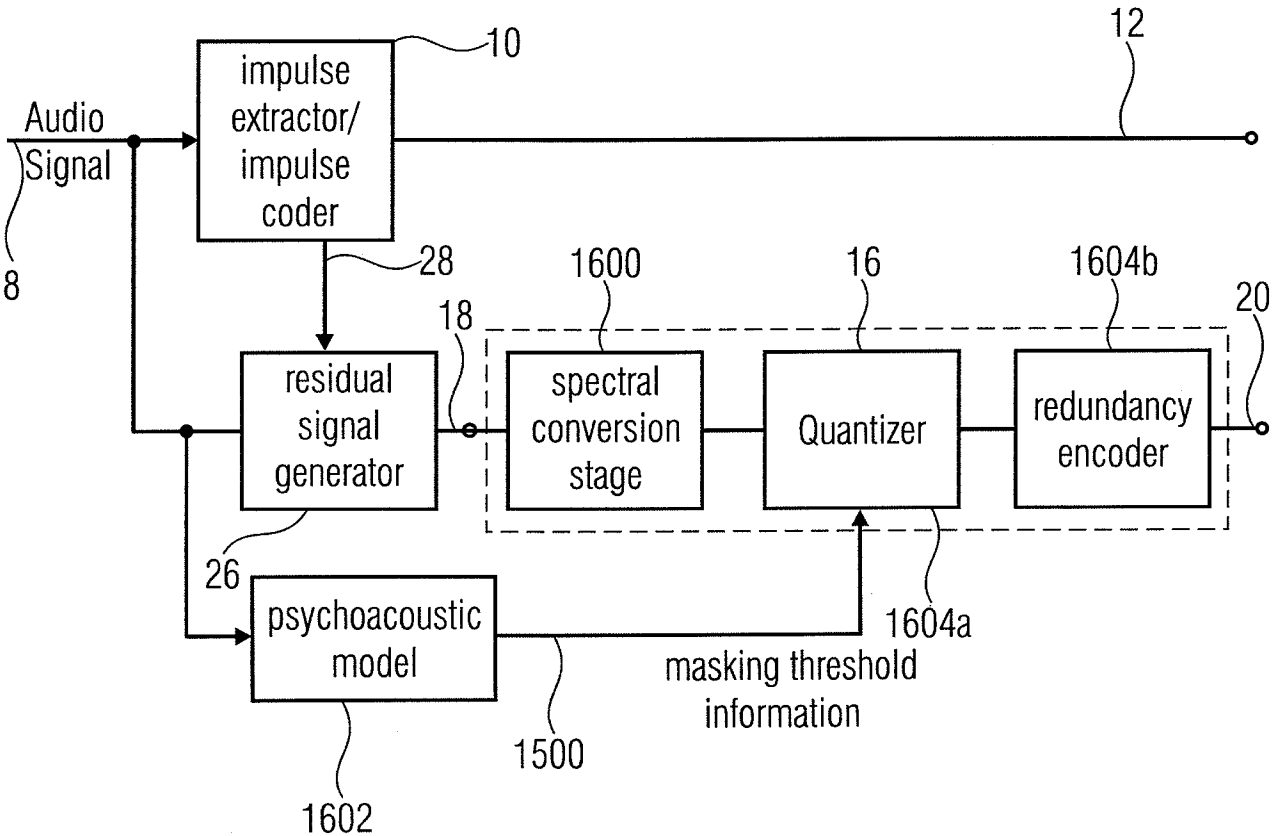
FIG. 15 illustrates an encoder embodiment in which the signal encoder includes a psychoacoustic model.
Figure 16A:
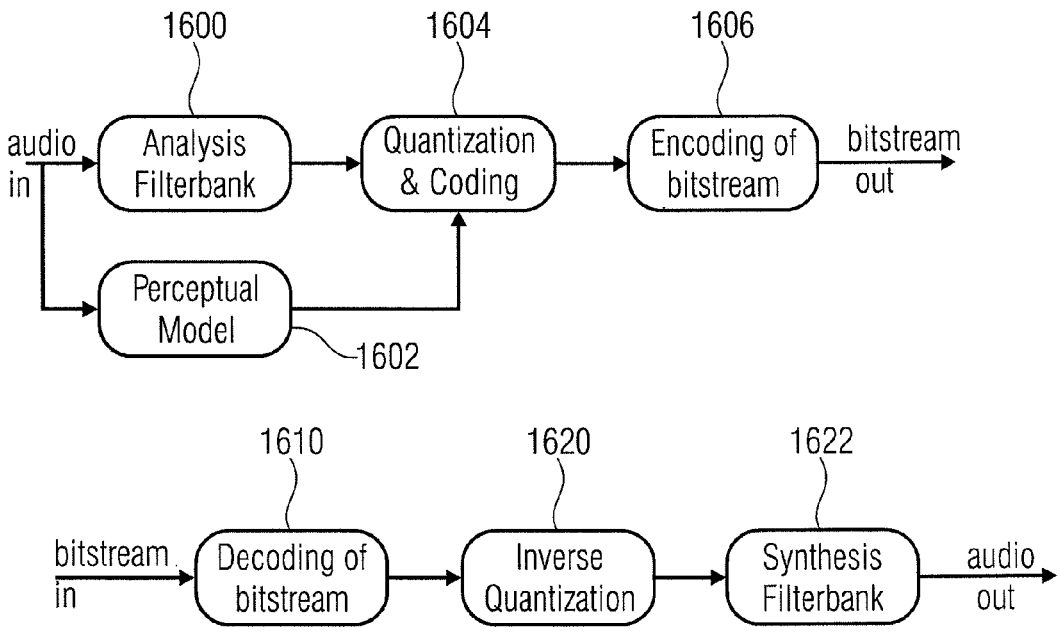
FIG 16A (Prior Art)
FIG. 16*a* illustrates an MP3 or MP4 coding/decoding concept.
Figure 16B:
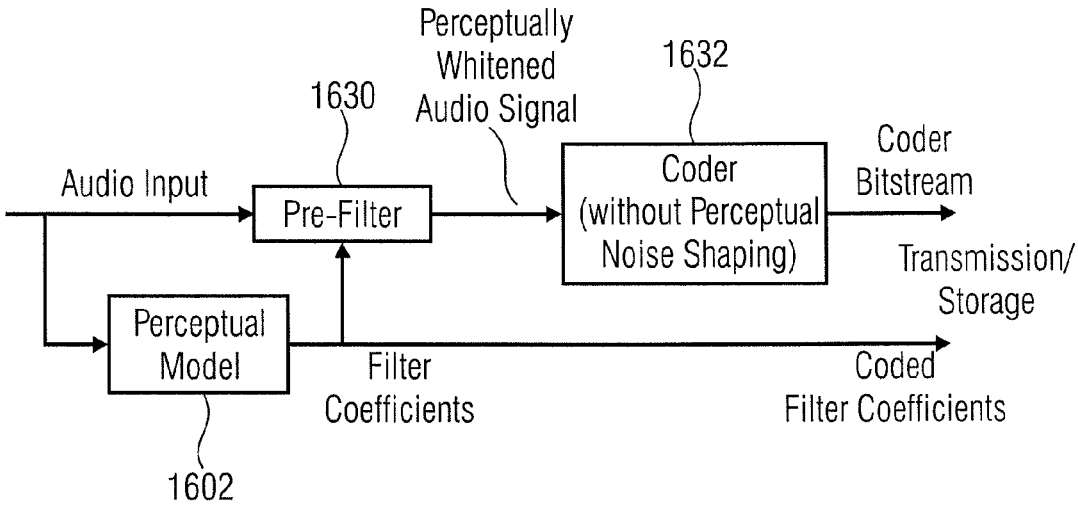
FIG 16B (Prior Art)
FIG. 16*b* illustrates a pre-filter encoding concept.
Figure 16C:
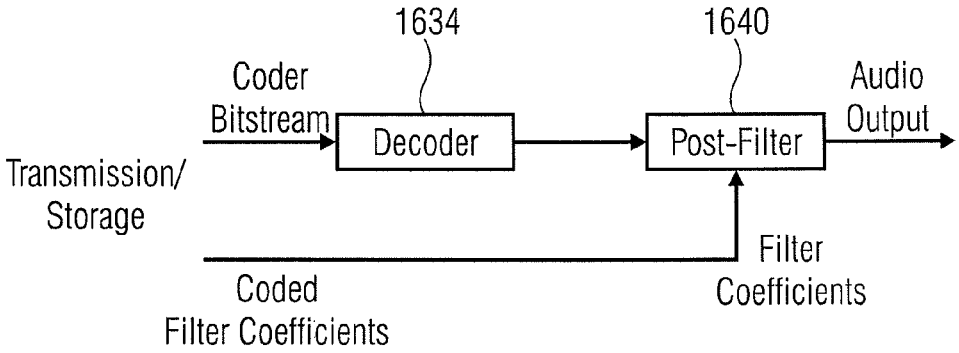
FIG 16C (Prior Art)
FIG. 16*c* illustrates a post-filter decoding concept.

Advantageously, a psychoacoustically controlled signal encoder 16 of FIG. 1 is used. Advantageously, the psychoacoustic model 1602, which is for example similar to the corresponding block in FIG. 16*a* is implemented in FIG. 15 so that its input is connected to the audio signal 8. This makes sure that the psychoacoustic masking threshold information on line 1500 reflects the situation of the original audio signal, rather than the residual signal at the output of the residual signal generator 26. Thus, the quantizer 1604*a* is controlled by masking threshold information 1500 which is not derived from the signal actually quantized, but which is derived from the original audio signal before the residual signal 18 was calculated. This procedure may be over a connection of psychoacoustic model input to the output of the residual signal generator 26 due to the fact that the masking effect of the impulse-like signal portion is utilized as well so that the bitrate can be further decreased. On the other hand, however, a connection of the psychoacoustic model input to the output of the residual signal generator 18 might also be useful, since the residual signal is an actual audio signal, and consequently, has a masking threshold. However, although this implementation is generally possible and useful for certain applications, it will produce a higher bitrate compared to the situation in which the psychoacoustic model 1602 is fed with the original audio signal.

Generally, embodiments of the present invention have several aspects which can be summarized as follows.

Encoding side: Method of signal splitting; filterbank-based layer is present; the speech enhancement is an optional layer; performing a signal analysis (the impulse extraction) prior to the coding; the impulse coder handles only a certain component of the input signal; the impulse coder is tuned to handle only impulses; and the filterbank-based layer is an unmodified filterbank-based coder. Decoding side: filterbank-based layer is present; and the speech enhancement is an optional layer.

Generally, the impulse coding method is selected in addition to the filterbank-based coding mode if the underlying source model for the impulses (e.g. glottal impulse excitation) fits well for the input signal, the impulse coding can start at any convenient point in time; the impulse coding mode is selected in addition to the filterbank-based coding mode if the underlying source model for the impulses (e.g. glottal impulse excitation) fits well for the input signal; and this does not involve an analysis of the rate-distortion behavior of both codec and is therefore vastly more efficient in the encoding process.

An advantageous impulse coding or pulse train coding method is the technique of waveform interpolation as described in "Speech coding below 4 kB/s using waveform interpolation", W. B. Kleijn, Globecom '91, pages 1879 to 1883, or in "A speech coder based on decomposition of characteristic waveforms", W. B. Kleijn and J. Haagen, ICASSP 1995, pages 508 to 511.

The below-described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Depending on certain implementation requirements of the inventive methods, the inventive methods can be implemented in hardware or in software. The implementation can be performed using a digital storage medium, in particular, a disc, a DVD or a CD having electronically-readable control signals stored thereon, which co-operate with programmable computer systems such that the inventive methods are performed. Generally, the present invention is therefore a computer program product with a program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

Literature:

[Edl00] B. Edler, G. Schuller: "Audio coding using a psychoacoustic pre- and post-filter", ICASSP 2000, Volume 2, 5-9 Jun. 2000 Page(s):II881-II884 vol. 2;

[Sch02] G. Schuller, B. Yu, D. Huang, and B. Edler, "Perceptual Audio Coding using Adaptive Pre- and Post-Filters and Lossless Compression", IEEE Transactions on Speech and Audio Processing, September 2002, pp. 379-390;

[Zwi] Zwicker, E. and H. Fastl, "Psychoacoustics, Facts and Models", Springer Verlag, Berlin;

[KHL97] M. Karjalainen, A. Härmä, U. K. Laine, "Realizable warped IIR filters and their properties", IEEE ICASSP 1997, pp. 2205-2208, vol. 3;

[SA99] J. O. Smith, J. S. Abel, "Bark and ERB Bilinear Transforms", IEEE Transactions on Speech and Audio Processing, Volume 7, Issue 6, November 1999, pp. 697-708;

[HKS00]Härmä, Aki; Karjalainen, Matti; Savioja, Lauri; Välimäki, Vesa; Laine, Unto K.; Huopaniemi, Jyri, "Frequency-Warped Signal Processing for Audio Applications", Journal of the AES, Volume 48 Number 11 pp. 1011-1031; November 2000;

[SOB03] E. Schuijers, W. Oomen, B. den Brinker, J. Breebaart, "Advances in Parametric Coding for High-Quality Audio", 114th Convention, Amsterdam, The Netherlands 2003, preprint 5852;

[WSKH05] S. Wabnik, G. Schuller, U. Kramer, J. Hirschfeld, "Frequency Warping in Low Delay Audio Coding", IEEE International Conference on Acoustics, Speech, and Signal Processing, Mar. 18-23, 2005, Philadelphia, Pa., USA;

[TMK94] K. Tokuda, H. Matsumura, T. Kobayashi and S. Imai, "Speech coding based on adaptive mel-cepstral analysis," Proc. IEEE ICASSP '94, pp. 197-200, April 1994;

[KTK95] K. Koishida, K. Tokuda, T. Kobayashi and S. Imai, "CELP coding based on mel-cepstral analysis," Proc. IEEE ICASSP '95, pp. 33-36, 1995;

[HLM99] Aki Härmä, Unto K. Laine, Matti Karjalainen, "Warped low-delay CELP for wideband audio coding", 17th International AES Conference, Florence, Italy, 1999;

[BLS05] B. Bessette, R. Lefebvre, R. Salami, "UNIVERSAL SPEECH/AUDIO CODING USING HYBRID ACELP/TCX TECHNIQUES," Proc. IEEE ICASSP 2005, pp. 301-304, 2005;

[Gri97] Grill, B., "A Bit Rate Scalable Perceptual Coder for MPEG-4 Audio", 103rd AES Convention, New York 1997, Preprint 4620; and

[Her02] J. Herre, H. Purnhagen: "General Audio Coding", in F. Pereira, T. Ebrahimi (Eds.), "The MPEG-4 Book", Prentice Hall IMSC Multimedia Series, 2002. ISBN 0-13-061621-4.

The invention claimed is:

1. Audio encoder for encoding an audio signal comprising an impulse-like portion and a stationary portion, comprising:

an impulse extractor configured for extracting the impulse-like portion from the audio signal, the impulse-extractor comprising an impulse coder for encoding the impulse-like portions to acquire an encoded impulse-like signal;

a signal encoder configured for encoding a residual signal derived from the audio signal to acquire an encoded residual signal, the residual signal being derived from the audio signal so that the impulse-like portion is reduced or eliminated from the audio signal; and an output interface configured for outputting the encoded impulse-like signal and the encoded residual signal, to provide an encoded signal, wherein the impulse encoder is configured for not providing an encoded impulse-like signal, when the impulse extractor is not able to find an impulse portion in the audio signal.

2. Audio encoder in accordance with claim 1, wherein the impulse coder and the signal coder are formed such that the impulse coder is better suited for impulse-like signals than the signal encoder and that the signal encoder is better suited for stationary signals than the impulse coder.

3. Audio encoder in accordance with claim 1, further comprising a residual signal generator, the residual signal generator being adapted for receiving the audio signal and information relating to the extracted impulse-like signal portions and for outputting the residual signal which does not comprise the extracted signal portions.

4. Audio encoder in accordance with claim 3, in which the residual signal generator comprises a subtractor for subtracting the extracted signal portions from the audio signal to acquire the residual signal.

5. Audio encoder in accordance with claim 3, in which the impulse extractor is operative to extract a parametric representation of the impulse-like signal portions; and in which the residual signal generator is operative to synthesize the wave form representation using the parametric representation, and to subtract the wave form representation from the audio signal.

6. Audio encoder in accordance with claim 3, in which the residual signal generator comprises an impulse decoder for calculating a decoded impulse-like signal, and a subtractor for subtracting the decoded impulse-like signal from the audio signal.

7. Audio encoder in accordance with claim 3, in which the impulse extractor comprises an LPC analysis stage for performing a LPC analysis of the audio signal, the LPC analysis being such that a prediction error signal is acquired, in which the impulse extractor comprises a prediction error signal processor for processing the prediction error signal such that an impulse like characteristic of this signal is enhanced, and in which the residual signal generator is operative to perform an LPC synthesis using the enhanced prediction error signal and to subtract a signal resulting from the LPC synthesis from the audio signal to acquire the residual signal.

8. Audio encoder in accordance with claim 1, in which the impulse extractor comprises an impulse/non-impulse decision stage, and in which a portion of the audio signal being detected as an impulse-like portion is provided to the impulse coder and is not provided to the signal encoder.

9. Audio encoder in accordance with claim 8, in which the impulse/non-impulse stage is a voiced/unvoiced decision stage.

10. Audio encoder in accordance with claim 1, in which the audio signal comprises a formant structure and a fine structure, in which the impulse extractor is operative to process the audio signal so that a processed signal only represents the fine structure, and to process the fine structure signal so that the impulse-like characteristic of the fine structure signal is enhanced, and in which the enhanced fine structure signal is encoded by the impulse coder.

11. Audio encoder in accordance with claim 1, in which the signal encoder is a transform or filterbank based general audio encoder, and in which the impulse coder is a time domain based coder.

12. Audio encoder in accordance with claim 1, in which the impulse extractor comprises an ACELP coder comprising an LPC analysis stage to acquire short-term predictor information, a pitch determination stage for acquiring pitch information and a long-term predictor gain, and a codebook stage for determining codebook information relating to pulse positions of a number of pulses used for the parametric representation of a residual signal, and wherein the impulse extractor is operative to control the ACELP coder depending on the long-term prediction gain to allocate either a variable number of pulses for the first long-term prediction gain or a fixed number of pulses for a second long-term prediction gain, wherein the second long-term prediction gain is greater than the first long-term prediction gain.

13. Audio encoder in accordance with claim 12, in which a maximum of the variable number of pulses is equal or lower than the fixed number.

14. Audio encoder in accordance with claim 12, wherein the impulse extractor is operative to control the ACELP coder so that a gradual allocation starting from a small number of pulses and proceeding to a higher number of pulses is performed, and wherein the gradual allocation is stopped, when an error energy is below a predetermined energy threshold.

15. Audio encoder in accordance with claim 12, in which the impulse extractor is operative to control the ACELP coder, so that in case of a long-term predictor gain being higher than a threshold, possible pulse positions are determined to be in a grid which is based on at least one pulse position from a preceding frame.

16. Audio encoder in accordance with claim 3, in which the impulse coder is a code excited linear prediction (CELP) encoder calculating impulse positions and quantized impulse values, and in which the residual signal generator is operative to use unquantized impulse positions and quantized impulse values for calculating a signal to be subtracted from the audio signal to acquire the residual signal.

17. Audio encoder in accordance with claim 3, in which the impulse extractor comprises a CELP analysis by synthesis process for determining unquantized impulse positions in the prediction error signal, and in which the impulse coder is operative to code the impulse position with a precision higher than a precision of a quantized short-term prediction information.

18. Audio encoder in accordance with claim 3, in which the impulse extractor is operative to determine a signal portion as impulse-like, and in which the residual signal generator is operative to replace the signal portion of the audio signal by a synthesis signal comprising a reduced or no impulse-like structure.

19. Audio encoder in accordance with claim 18, in which the residual signal generator is operative to calculate the synthesis signal by extrapolation from a border between an impulse-like signal and the non-impulse-like signal.

20. Audio encoder in accordance with claim 18, in which the residual signal generator is operative to calculate the synthesis signal by weighting the audio signal in the impulse-like portion using a weighting factor smaller than 0.5.

21. Audio encoder in accordance with claim 1, in which the signal encoder is a psychoacoustically driven audio encoder, wherein a psychoacoustic masking threshold used from quantizing audio values is calculated using the audio signal, and wherein the signal encoder is operative to convert the residual signal in a spectral representation and to quantize values of the spectral representation using the psychoacoustic masking threshold.

22. Audio encoder in accordance with claim 1, in which the impulse extractor is operative to extract an impulse-like signal from the audio signal to acquire an extracted impulse-like signal, in which the impulse extractor is operative to manipulate the extracted impulse-like signal to acquire an enhanced impulse-like signal with a more ideal impulse-like shape compared to a shape of the extracted impulse-like signal, in which the impulse coder is operative to encode the enhanced impulse-like signal to acquire an encoded enhanced impulse-like signal, and in which the audio encoder comprises a residual signal calculator for subtracting the extracted impulse-like signal or the enhanced impulse-like signal or a signal derived by decoding the encoded enhanced impulse-like signal from the audio signal to acquire the residual signal.

23. Audio encoder in accordance with claim 1, in which the impulse extractor is operative for extracting an impulse train, and in which the impulse coder is adapted for encoding an impulse-train like signal with higher efficiency or less encoding error than a non-impulse-train like signal.

24. Method of encoding an audio signal comprising an impulse-like portion and a stationary portion, comprising:

extracting the impulse-like portion from the audio signal, the extracting comprising encoding the impulse-like portions to acquire an encoded impulse-like signal;

encoding a residual signal derived from the audio signal to acquire an encoded residual signal, the residual signal being derived from the audio signal so that the impulse-like portion is reduced or eliminated from the audio signal; and outputting, by transmitting or storing, the encoded impulse-like signal and the encoded residual signal, to provide an encoded signal, wherein the impulse encoding is not performed, when the impulse-extracting does not find an impulse portion in the audio signal.

25. Decoder for decoding an encoded audio signal comprising an encoded impulse-like signal and an encoded residual signal, comprising:

an impulse decoder configured for decoding the encoded impulse-like signal using a decoding algorithm adapted to a coding algorithm used for generating the encoded impulse-like signal, wherein a decoded impulse-like signal is acquired;

a signal decoder configured for decoding the encoded residual signal using a decoding algorithm adapted to a coding algorithm used for generating the encoded residual signal, wherein a decoded residual signal is acquired; and a signal combiner configured for combining the decoded impulse-like signal and the decoded residual signal to provide a decoded output signal, wherein the signal decoder and the impulse decoder are operative to provide output values related to the same time instant of a decoded signal, wherein the impulse decoder is operative to receive the encoded impulse-like signal and provide the decoded impulse-like signal at specified time portions separated by periods in which the signal decoder provides the decoded residual signal and the impulse decoder does not provide the decoded impulse-like signal, so that the decoded output signal comprises the periods in which the decoded output signal is identical to the decoded residual signal and the decoded output signal comprises the specified time portions in which the decoded output signal comprises the decoded residual signal and the decoded impulse-like signal or comprises the decoded impulse-like signal only.

26. Decoder in accordance with claim 25, in which the impulse decoder is a time domain decoder and the signal decoder is a filterbank or transform based decoder.

27. Decoder in accordance with claim 25, in which the encoded audio signal comprises side information indicating information relating to an encoding or decoding characteristic pertinent to the residual signal, and in which the combiner is operative to combine the decoded residual signal and the decoded impulse-like signal in accordance with the side information.

28. Decoder in accordance with claim 25, in which the side information indicates that, at an impulse-like portion, a synthetic signal has been generated in the residual signal, and in which the combiner is operative to suppress or at least attenuate the decoded residual signal during the impulse-like portion in response to the side information.

29. Decoder in accordance with claim 25, in which the side information indicates that an impulse-like signal has been attenuated by an attenuation factor before being subtracted from the audio signal, and in which the combiner is operative to attenuate the decoded residual signal based on the attenuation factor and to use the attenuated decoded signal for a combination with the decoded impulse-like signal.

30. Decoder in accordance with claim 25, in which the encoded impulse-like signal comprises an impulse-train like signal, and in which the decoder for decoding the encoded impulse-like signal is operative to use a decoding algorithm adapted to a coding algorithm, wherein the coding algorithm is adapted for encoding an impulse-train like signal with higher efficiency or less encoding error than a non-impulse-train like signal.

31. Method of decoding an encoded audio signal comprising an encoded impulse-like signal and an encoded residual signal, comprising:

decoding the encoded impulse-like signal using a decoding algorithm adapted to a coding algorithm used for generating the encoded impulse-like signal, wherein a decoded impulse-like signal is acquired;

decoding the encoded residual signal using a decoding algorithm adapted to a coding algorithm used for generating the encoded residual signal, wherein a decoded residual signal is acquired; and combining the decoded impulse-like signal and the decoded residual signal to provide a decoded output signal, wherein the decoding is operative to provide output values related to the same time instant of a decoded signal, wherein, in decoding the encoded impulse-like signal, the encoded impulse-like signal is received and the decoded impulse-like signal is provided at specified time portions separated by periods in which the decoding the encoded residual signal provides the decoded residual signal and the decoding the encoded impulse-like signal does not provide the decoded impulse-like signal, so that the decoded output signal comprises the periods, in which the decoded output signal is identical to the decoded residual signal and the decoded output signal comprises the specified time portions in which the decoded output signal comprises the decoded residual signal and the decoded impulse-like signal or comprises the impulse-like signal only.

32. Non-transitory storage medium having stored thereon a computer program comprising instructions, which when executed by a processor, cause the processor to perform a method of encoding an audio signal comprising an impulse-like portion and a stationary portion, comprising: extracting the impulse-like portion from the audio signal, the extracting comprising encoding the impulse-like portions to acquire an encoded impulse-like signal; encoding a residual signal derived from the audio signal to acquire an encoded residual signal, the residual signal being derived from the audio signal so that the impulse-like portion is reduced or eliminated from the audio signal; and outputting, by transmitting or storing, the encoded impulse-like signal and the encoded residual signal, to provide an encoded signal, wherein the impulse encoding is not performed, when the impulse-extracting does not find an impulse portion in the audio signal, when running on a processor.

33. Non-transitory storage medium having stored thereon a computer program comprising instructions, which when executed by a processor, cause the processor to perform a method of decoding an encoded audio signal comprising an encoded impulse-like signal and an encoded residual signal, comprising: decoding the encoded impulse-like signal using a decoding algorithm adapted to a coding algorithm used for generating the encoded impulse-like signal, wherein a decoded impulse-like signal is acquired; decoding the encoded residual signal using a decoding algorithm adapted to a coding algorithm used for generating the encoded residual signal, wherein a decoded residual signal is acquired; and combining the decoded impulse-like signal and the decoded residual signal to provide a decoded output signal, wherein the decoding are operative to provide output values related to the same time instant of a decoded signal, wherein, in decoding the encoded impulse-like signal, the encoded impulse-like signal is received and the decoded impulse-like signal is provided at specified time portions separated by periods in which the decoding the encoded residual signal provides the decoded residual signal and the decoding the encoded impulse-like signal does not provide the decoded impulse-like signal, so that the decoded output signal comprises the periods, in which the decoded output signal is identical to the decoded residual signal and the decoded output signal comprises the specified time portions in which the decoded output signal comprises the decoded residual signal and the decoded impulse-like signal or comprises the impulse-like signal only, when running on a processor.

* * * * *

UNITED STATES PATENT AND TRADEMARK OFFICE

CERTIFICATE OF CORRECTION

PATENT NO. : 8,706,480 B2
APPLICATION NO. : 12/663828
DATED : April 22, 2014
INVENTOR(S) : Herre et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1157 days.

Signed and Sealed this
Twenty-ninth Day of September, 2015

Michelle K. Lee

Michelle K. Lee
*Director of the United States Patent and Trademark Office*